US007537036B2

(12) United States Patent
Namekawa et al.

(10) Patent No.: US 7,537,036 B2
(45) Date of Patent: May 26, 2009

(54) ADHESIVE-TAPE CUTTER AND ADHESIVE TAPE

(75) Inventors: Hidejiro Namekawa, Sailama (JP); Mitsuaki Imazeki, 2914, Inouchi, Narutoumachi, Sanbu-gun, Chiba (JP) 289-1304

(73) Assignee: Mitsuaki Imazeki, Chiba (JP)

( * ) Notice: Subject to any disclaimer, the term of this patent is extended or adjusted under 35 U.S.C. 154(b) by 476 days.

(21) Appl. No.: 11/252,900

(22) Filed: Oct. 18, 2005

(65) Prior Publication Data

US 2006/0175017 A1 Aug. 10, 2006

(51) Int. Cl.
*B31F 1/08* (2006.01)
*B65H 35/07* (2006.01)

(52) U.S. Cl. ..... 156/463; 156/227; 156/465; 156/526; 225/77; 225/88; 493/455

(58) Field of Classification Search ..... 156/227, 156/269, 461, 463, 465, 510, 526, 527, 574, 156/577; 225/77, 88; 493/438, 439, 455
See application file for complete search history.

(56) References Cited

U.S. PATENT DOCUMENTS 2,309,093 A * 1/1943 Borden ..... 493/328
2,581,190 A * 1/1952 Hodges ..... 72/129
2,911,214 A * 11/1959 Sherbrook ..... 493/394
4,576,674 A * 3/1986 Le Tarte ..... 156/463
4,606,784 A * 8/1986 Glans et al. ..... 156/200
5,405,471 A * 4/1995 LeMaster ..... 156/202
6,824,637 B2 * 11/2004 Mullet et al. ..... 156/202
6,945,297 B1 * 9/2005 Gonzalez et al. ..... 156/463
2001/0000096 A1 * 4/2001 Tolerico et al. ..... 156/200
2004/0238109 A1 * 12/2004 Gonzalez ..... 156/227
2006/0175017 A1 8/2006 Namekawa

FOREIGN PATENT DOCUMENTS

JP 2000-8005 1/2000
JP 2002-114437 4/2002
JP 2003-11081 1/2003
JP 2003206066 7/2003
JP 2003206067 7/2003
JP 2001-199620 7/2004

OTHER PUBLICATIONS

JPO Notification of Reasons for Rejection, Jan. 13, 2009.

* cited by examiner

*Primary Examiner*—Mark A Osele
(74) *Attorney, Agent, or Firm*—Clements Bernard PLLC; Christopher L. Bernard; Seth L. Hudson

(57) ABSTRACT

An adhesive tape cutter provided with a double-portion forming means that folds a longitudinal side edge of a predetermined width of adhesive tape in the direction that its adhesive face is facing to form a double portion as a non-adhesive portion by pulling out the adhesive tape through between adhesive face-side members disposed on the side faced by the adhesive face and non-adhesive face-side members disposed on the side faced by a non-adhesive face thereof with both the members contacting and pressing against the adhesive tape.

8 Claims, 22 Drawing Sheets

ADHESIVE-TAPE CUTTER AND ADHESIVE TAPE

CROSS-REFERENCE TO RELATED APPLICATIONS

The present application claims priority from PCT International Patent Application No. PCT/JP2004/005449 designating the U.S.A. filed on Apr. 16, 2004 and published in Japanese on Nov. 25, 2004, which is herein incorporated by reference.

BACKGROUND OF THE INVENTION

1. Technical Field

The present invention relates to a tape cutter which folds back a longitudinal side edge of adhesive tape pulled out to have a desired length from an adhesive-tape roll so that opposite adhesive faces stick together to form a non-adhesive portion, and adhesive tape for use by the tape cutter.

2. Description of the Related Art

Adhesive tape is a thin film-like strip base made of cloth, cellophane, craft paper, rubber, polyvinyl chloride, or the like which has its one surface coated with an adhesive made mainly from rubber or synthetic resin, and usually this adhesive tape is rolled into an adhesive-tape roll, which is available on the market. Such adhesive tapes are used in various sticking applications such as closing envelops or bags, or joining boxes and lids.

When using such adhesive tape, the adhesive tape is pulled out from an adhesive-tape roll and cut to have a desired length. In order to facilitate this task, a tape cutter is used.

The tape cutter comprises a tape holder to rotatably support an adhesive-tape roll and a cutting section to cut adhesive tape pulled out, and enables adhesive tape pulled out to have a desired length to be easily cut without using a tool such as a pair of scissors or a cutter knife, for being provided to adhere to objects to be joined.

Although being for use in various sticking applications, adhesive tapes are often used to temporarily join, and after use, removed or cut.

Since the strip base of the adhesive tape is thin and has its one entire surface coated with an adhesive, it is fairly troublesome to remove the adhesive tape sticking to an object from it. That is, when removing an adhesive tape whose entire adhesive face is sticking to an object, one needs to turn up the outer edge of the adhesive tape with his/her nail so as to form a picking-off margin, and takes hold of the picking-off margin with the tips of his/her fingers and picks the adhesive tape off. The turning up of a picking-off margin causes much trouble.

For example, for food such as boxed meals and daily dishes sold at convenience stores, adhesive tapes of about ten and several mm in width are often used to attach lids to food containers or to stick seasoning bags having seasoning such as sauce or dressing enclosed therein to the outside of food containers. If the adhesive tape is stuck across the entire surface, a purchaser has much difficulty and trouble in picking the adhesive tape off to open the lid of the container or remove the seasoning bag from the container.

Accordingly, in the conventional art, an adhesive tape cutter technique is disclosed in Japanese Patent Application Laid-Open Publication No. 2001-302078 where in order to facilitate the picking-off, while pulling out adhesive tape, a side edge of the adhesive tape is automatically folded back along the longitudinal side so that opposite adhesive faces stick together to form a non-adhesive, picking-off portion.

The adhesive tape cutter disclosed in the above-referenced publication is configured as follows (1 to 8):

1) to have a support shaft rotatably supporting an adhesive-tape roll on one side of its casing and an adhesive-holding portion for a tape pulled out and a cutting blade on the other side;
2) to have a double-portion forming means that folds back a side edge of a predetermined width of the pulled-out adhesive tape along the longitudinal side so that opposite adhesive faces stick together to form a non-adhesive, picking-off portion, in an adhesive tape pulling-out path from the tape roll to the adhesive-holding portion;
3) the double-portion forming means comprising a pulling-out guide roller, a bending roller, a side bending guide roller, a conical folding roller, an adhesive face-side press roller, and a non-adhesive face-side press roller, which are arranged in that order from the support shaft side to the adhesive-holding portion side;
4) to have an open/close member that covers the adhesive tape pulling-out path in an openable/closable manner and freely rotates upwards about the pulling-out guide roller supported by the casing above the adhesive tape pulling-out path;
5) wherein the bending roller is supported by the casing and contacts the adhesive face of the adhesive tape except for a side edge of a predetermined width to be bent, and the side bending guide roller is vertically supported by the casing such that its circumferential surface faces an end face of the bending roller and contacts and presses against the non-adhesive face of the side edge, not contacting the bending roller, to sandwich this side edge between the end face of the bending roller and itself and to bend the side edge of the predetermined width backward or in the direction that the adhesive face is facing to be at an angle of about 90°;
6) wherein the adhesive face-side press roller and the non-adhesive face-side press roller are arranged vertically and sandwich and press the adhesive tape against each other;
7) wherein the non-adhesive face-side press roller is supported by the open/close member and, when the open/close member is opened/closed, is moved from/to the adhesive face-side press roller; and
8) wherein the loading of the adhesive tape is performed when the open/close member is open upwards, in which the adhesive tape is passed under the pulling-out guide roller, then above the bending roller, the conical folding roller, and the adhesive face-side press roller, and after the leading end of the adhesive tape is attached onto the adhesive-holding portion, the side edge of the adhesive tape is bent into between the bending roller and the side bending guide roller, and then the open/close member is closed to finish the loading.

However, in the conventional adhesive tape cutter described in the above-referenced publication, the open/close member is rotated to open/close about the rotation axis of the pulling-out guide roller nearest the tape support. Hence, the path for the adhesive tape to pass through cannot be exposed open over its entire length. Thus, it is a troublesome task particularly to pass adhesive tape under the pulling-out guide roller. Moreover, the task of bending and inserting a side edge of the pulled-out adhesive tape into between the bending roller and the side bending guide roller is necessary but causes much trouble.

SUMMARY OF THE INVENTION

The present invention can solve the above and other problems, and an object thereof is to provide an adhesive tape cutter that can easily form a non-adhesive portion along the longitudinal direction as a picking-off portion to facilitate removal of the adhesive tape by folding a side edge of the adhesive tape back to stick with the opposite face, also easily switch on/off the function to form the non-adhesive portion, and readily insert and load the adhesive tape.

In order to achieve the above and other objects, according to an embodiment of this invention, there is provided an adhesive tape cutter having a main body provided with a tape support that rotatably supports an adhesive tape roll in which adhesive tape having one adhesive face is wound like a roll and a cutting section that cuts the adhesive tape pulled out from the adhesive tape roll supported by the tape support, wherein between the tape support and the cutting section of the main body there is provided a double-portion forming means that includes adhesive face-side members disposed on a side faced by the adhesive face of the adhesive tape and non-adhesive face-side members disposed on a side faced by a non-adhesive face thereof and that folds at least a longitudinal side edge of a predetermined width of the adhesive tape in a direction that the adhesive face is facing to form a double portion as a non-adhesive portion by pulling out the adhesive tape through between the adhesive face-side members and the non-adhesive face-side members with both the members contacting and pressing against the adhesive tape. The adhesive tape cutter is characterized in that the double-portion forming means comprises a bending roller as an adhesive face-side member that contacts the adhesive face of the adhesive tape except the side edge of the predetermined width to be bent; a bending guide block as one of the non-adhesive face-side members that is placed opposite an end face of the bending roller and contacts and presses against the non-adhesive face of the side edge of the predetermined width to be bent, not contacting the bending roller, to sandwich the side edge between the end face of the bending roller and itself and bend the side edge of the predetermined width in the direction that the adhesive face is facing; a folding guide block as one of the adhesive face-side members that has a guide portion contacting and pressing against the non-adhesive face of the bent side edge to bend the side edge to be at an acute angle and that is placed on the side faced by the adhesive face of the adhesive tape; and a sticking means as one of the non-adhesive face-side members that contacts and presses against the non-adhesive face of the adhesive tape having the side edge folded to stick together opposite adhesive faces of the folded adhesive tape; the non-adhesive face-side members are supported by an open/close member that is openable and closable, and the open/close member is configured to be movable between a closed position where the non-adhesive face-side members contact and press against the adhesive tape through the double-portion forming means and an open position where the non-adhesive face-side members do not, and in the open position, the non-adhesive face-side members are apart from the adhesive face-side members such that a path for the adhesive tape to be inserted through is opened up.

The folding guide block may have a first guide portion that guides and bends the side edge of the adhesive tape at a bending angle of about 135° and a second guide portion that bends the side edge at a bending angle of about 180°.

Further, the first guide portion and the second guide portion together may form a continuous curved surface on one side.

Yet further, on the bending guide block, a guide protrusion may be formed so as to contact the non-adhesive face of the bent side edge to guide and bend the side edge at a bending angle of about 120°.

Still further, a press member of the sticking means may be a guide roller.

Further, the double-portion forming means may be fixed to a cassette-type holder that is attachable to and detachable from the main body.

Yet further, between the tape support and the double-portion forming means, there may be provided a positioning means that positions the adhesive tape pulled out from the adhesive tape roll in such a position as to be fed to the double-portion forming means.

Still further, the positioning means may be fixed to the open/close member.

Further, the open/close member may be moved between the open position where close and the closed position where apart, perpendicularly to the non-adhesive face of the adhesive tape.

Alternatively, the open/close member may be moved between the open and closed positions by being rotated sideways relative to a direction that the adhesive tape is inserted through the path.

Other tasks of this application and ways to achieve the tasks will be made clear by the explanation of the embodiments of the present invention and the accompanying drawings.

DETAILED DESCRIPTION OF THE INVENTION

Embodiments of an adhesive tape cutter and adhesive tape according to the present invention will be described below in detail based on the accompanying drawings.

First Embodiment

Figure 1:
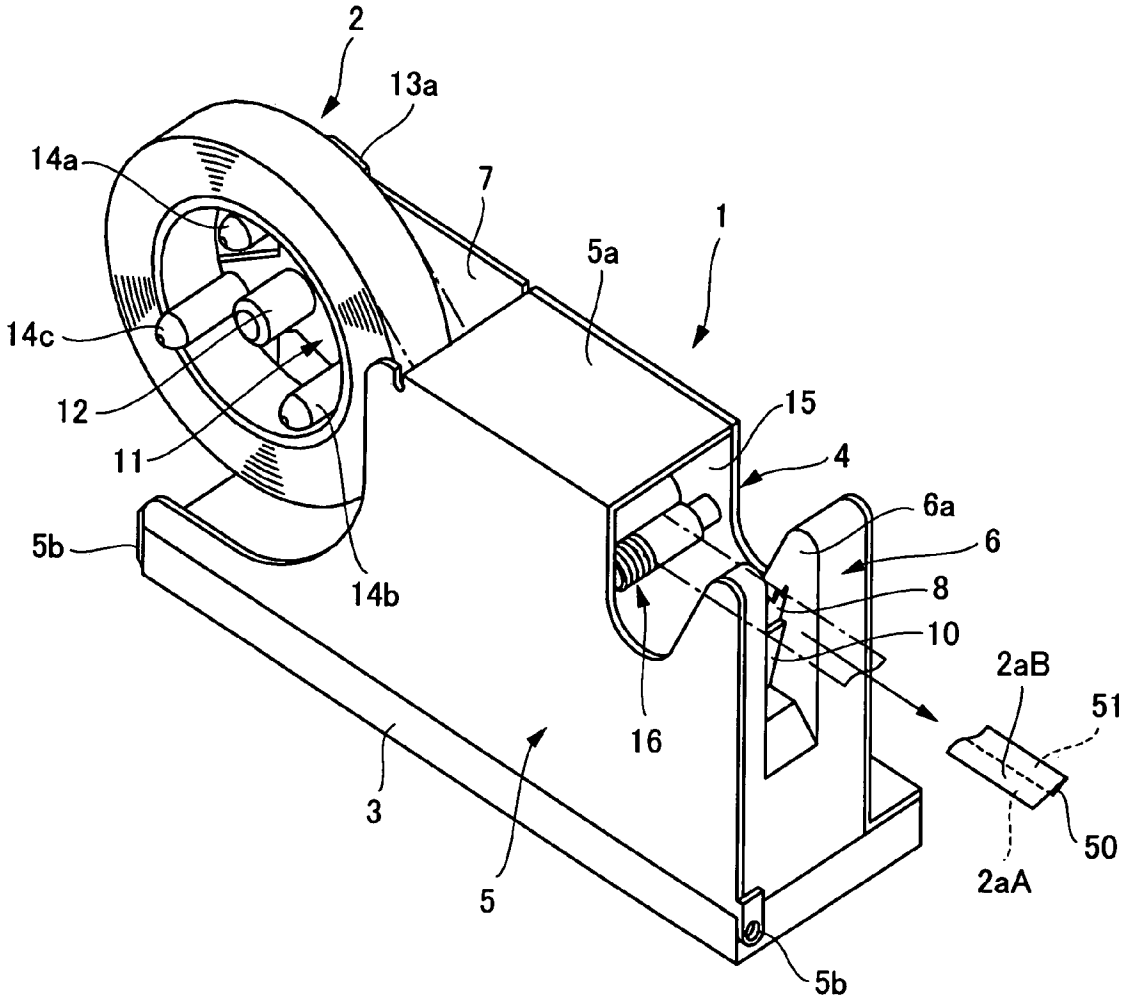
FIG. 1 is a perspective view illustrating a first embodiment of an adhesive tape cutter according to the present invention.
Figure 2:
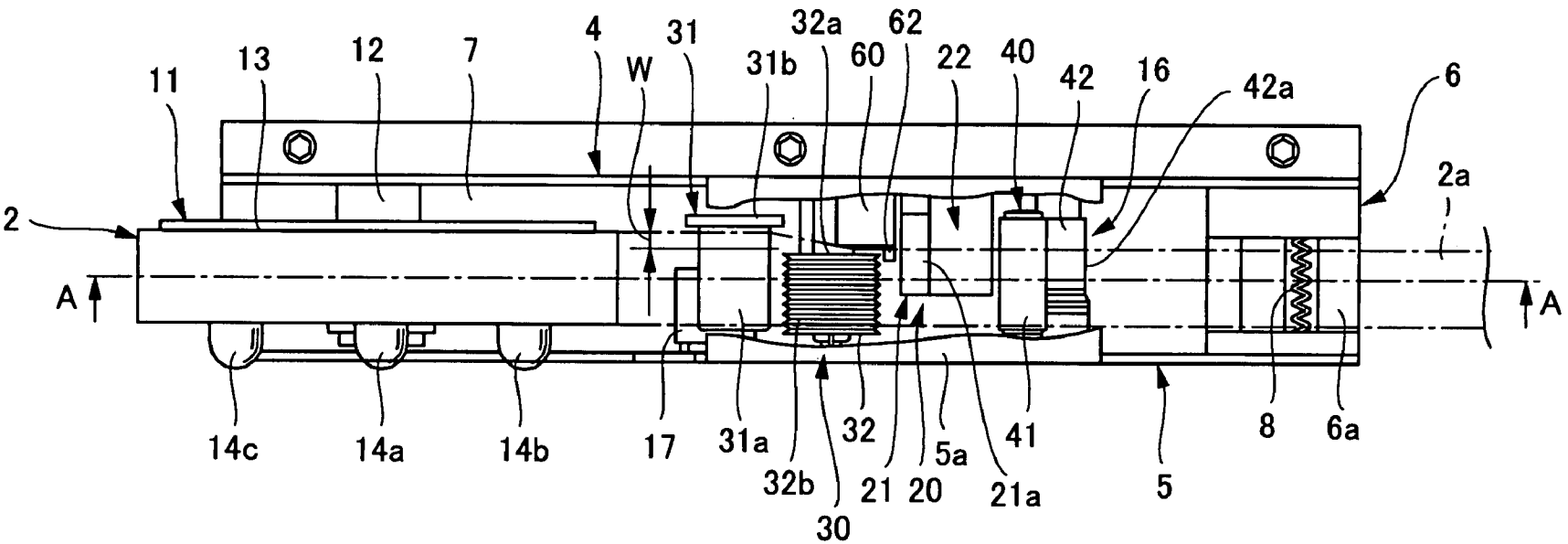
FIG. 2 is a partially cut-away plan view illustrating the configuration of the adhesive tape cutter of FIG. 1.
Figure 3:
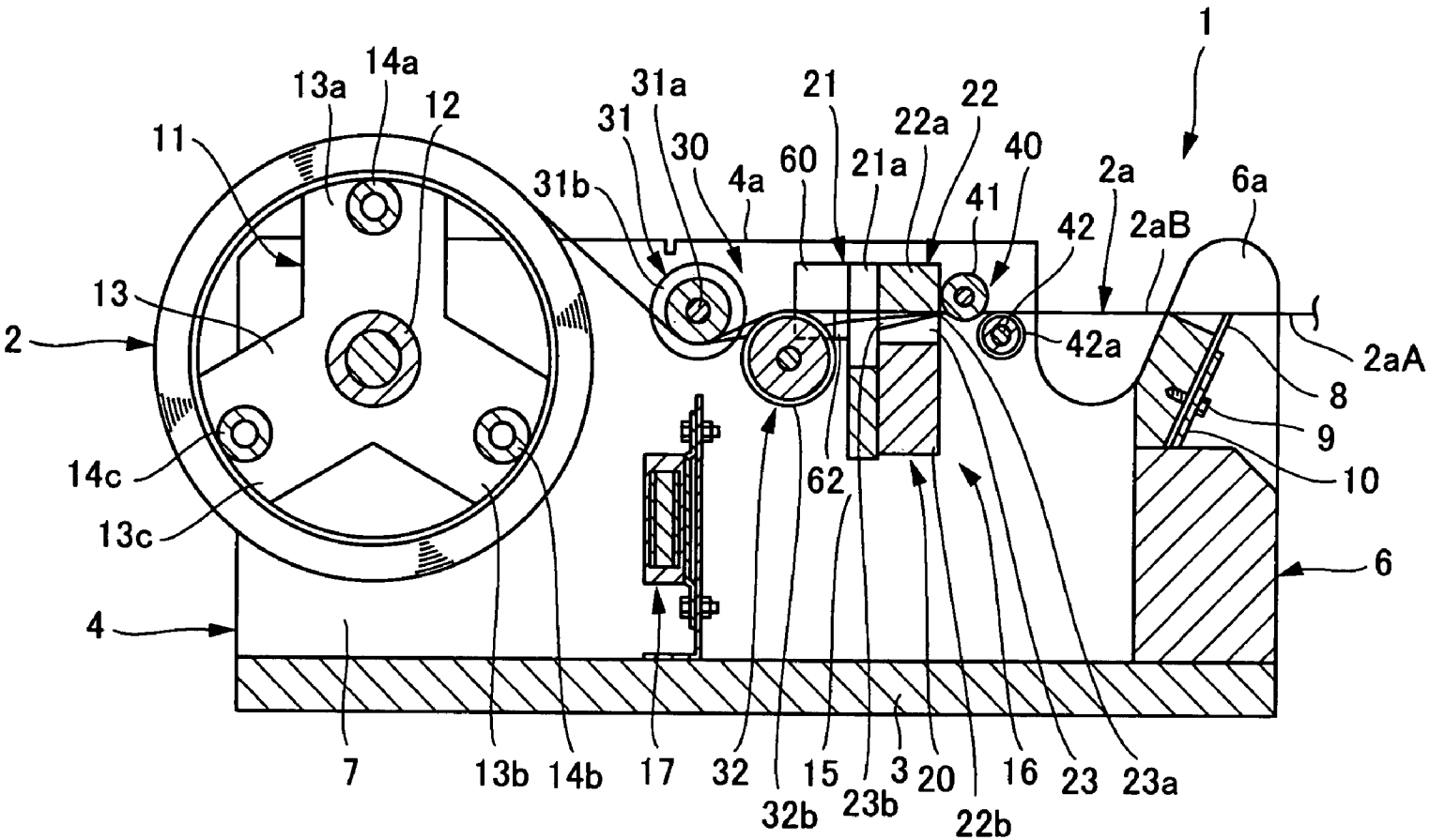
FIG. 3 is a sectional view along line A-A of FIG. 2.
Figure 4:
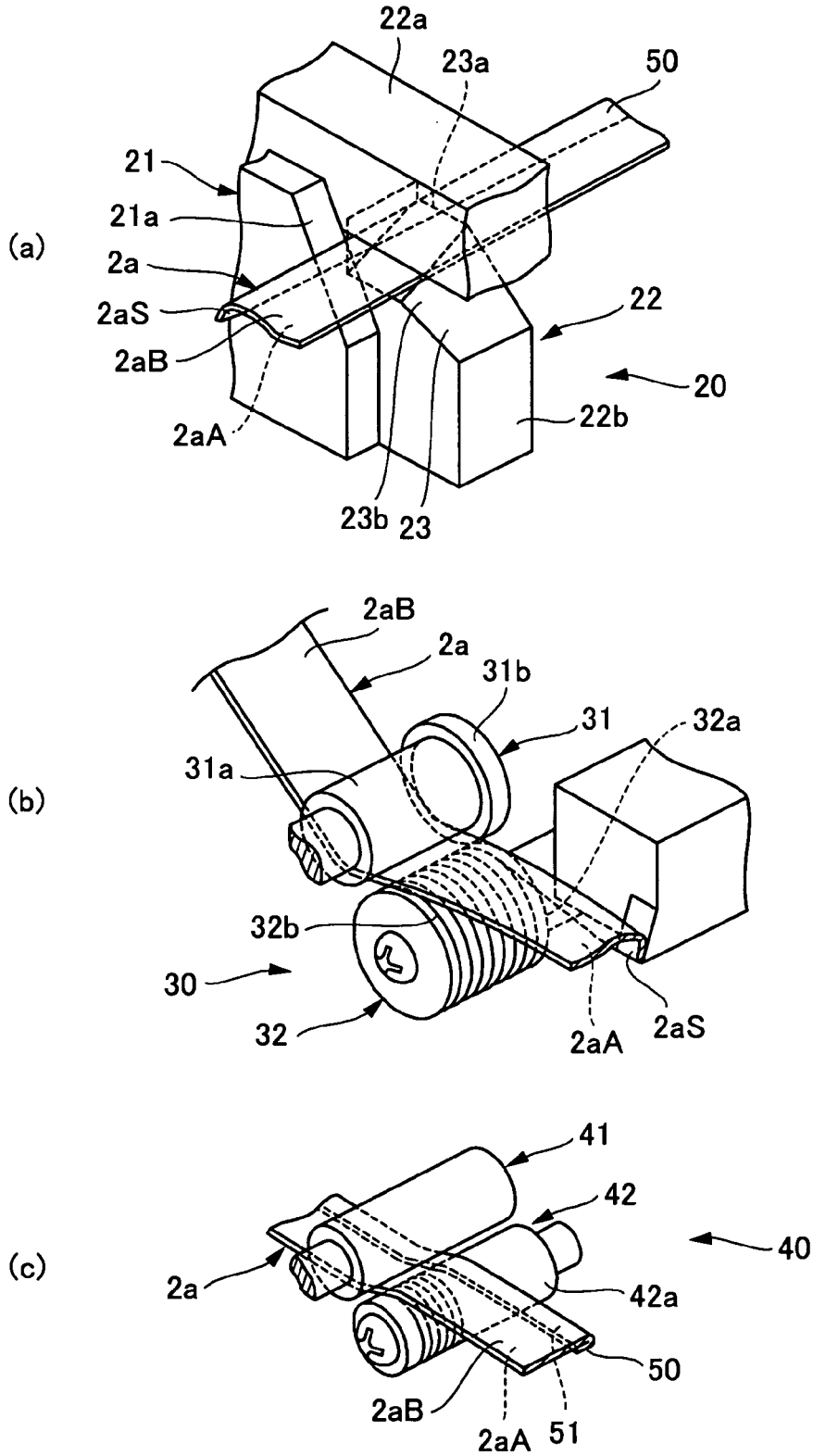
FIGS. 4A to 4C are detailed perspective views of a bending mechanism, folding mechanism, and sticking mechanism of a double-portion forming means shown in FIG. 2 respectively.
Figure 5:
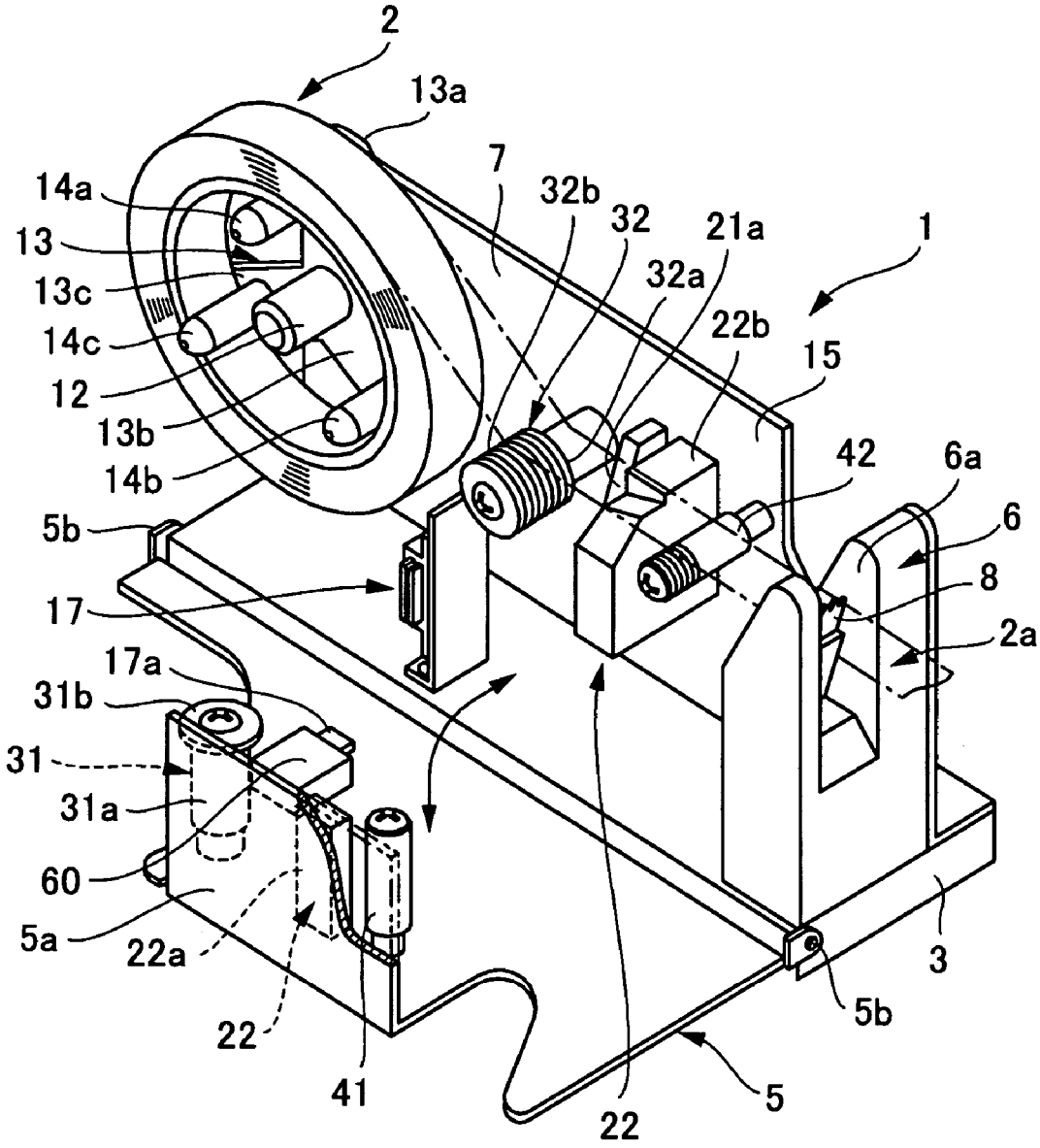
FIG. 5 is a perspective view showing the state where an open/close cover of FIG. 1 is open.

FIG. 1 is a perspective view illustrating a first embodiment of the adhesive tape cutter according to the present invention; FIG. 2 is a partially cut-away plan view illustrating the configuration of the adhesive tape cutter of FIG. 1; and FIG. 3 is a sectional view along line A-A of FIG. 2. FIGS. 4A to 4C are detailed perspective views of a bending mechanism, folding mechanism, and sticking mechanism of a double-portion forming means shown in FIG. 2 respectively, and FIG. 5 is a perspective view showing the state where an open/close cover of FIG. 1 is open.

The adhesive tape cutter 1 of FIG. 1 is used to pull out a piece of the adhesive tape 2*a* to have a desired length from an adhesive-tape roll 2 into which adhesive tape 2*a* of about 10 mm in width having its one face, an adhesive face 2*a*A, coated with an adhesive is wound like a roll and to cut it off.

This tape cutter 1 has a main body consisting of a resin-made base 3 formed in a substantially rectangular solid, a resin-made fixed cover 4 fixed to one side of the base 3, and a resin-made open/close cover 5 as an open/close member coupled to the other side of the base 3 to freely open/close. Furthermore, a cutter support 6 is provided on one side in the longitudinal direction of the main body of the tape cutter 1, and a tape housing section 7 is provided on the other side.

The cutter support 6, made of resin, is placed in between the fixed cover 4 and the open/close cover 5 and fixed to the base 3. As shown in FIG. 1, a cut 6*a* open upwards is made at a position offset in the width direction from the center in the cutter support 6, and a cutter blade 8 as a cutting section is mounted in the cut 6*a*. The cutter blade 8 is sandwiched and fixed between the cutter support 6 and a fixed plate 10 fixed by a bolt 9 to the cutter support 6 such that the blade end faces upwards in FIG. 1.

In the tape housing section 7, the adhesive-tape roll 2 held by a tape holder 11 as a tape support is housed. The tape holder 11 has a holder shaft 12 at its center axis and a holder plate 13 fixed to the holder shaft 12, and the holder shaft 12 is rotatably supported by the fixed cover 4 to freely rotate. The holder plate 13 has three legs 13*a*, 13*b*, 13*c* extending radially, and tape support pins 14*a*, 14*b*, 14*c* are fixed to the ends of the legs 13*a*, 13*b*, 13*c* respectively. These tape support pins 14*a*, 14*b*, 14*c* are arranged so as to engage with the inner surface of the adhesive-tape roll 2 at three points and hold it. The adhesive-tape roll 2 is held on the tape holder 11 by the tape support pins 14*a*, 14*b*, 14*c* engaging and holding it, and can freely rotate relative to the fixed cover 4 by means of the tape holder 11.

Provided between the cutter support 6 and the tape housing section 7 is a tape inserting chamber 15 enclosed by the fixed cover 4, the open/close cover 5, and a top plate 5*a* provided on the top end of this cover, through which chamber the adhesive tape 2*a* pulled out from the adhesive-tape roll 2 is inserted.

One end of the tape inserting chamber 15 is communication with the tape housing section 7, and the other end is open to the cutter support 6. The adhesive tape 2*a* pulled out from the adhesive-tape roll 2 supported by the tape holder 11 extends from the tape housing section 7 through the tape inserting chamber 15 to the cutter support 6.

Disposed in the tape inserting chamber 15 is a double-portion forming means 16 which comprises a bending mechanism 30 that bends one longitudinal side edge 2*a*S of the pulled-out adhesive tape 2*a* in the direction that the adhesive face is facing (backward) or downward to be at an angle of about 90°; a folding mechanism 20 that further bends the bent side edge 2*a*S to be at about 180° so that the adhesive faces are facing each other; and a sticking means 40 that sticks the opposite adhesive faces together.

The bending mechanism 30, as shown in FIGS. 2, 3, 4A, comprises a positioning roller 31 as a positioning means, a bending roller 32 as a bending means, and a bending guide block 60.

The positioning roller 31 is provided in between the tape holder 11 as the tape support and the bending roller 32, to position the adhesive tape 2*a* pulled out from the adhesive-tape roll 2 in such a position as to be fed to the bending roller 32, and comprises a roller main body 31*a* and a flange 31*b* provided on the end of the roller main body 31*a* and is rotatably, pivotably coupled to the open/close cover 5. The non-adhesive face 2*a*B of the adhesive tape 2*a* pulled out from the adhesive-tape roll 2 contacts and is pressed on the roller main body 31, and the flange 31*b* contacts one side end of the adhesive tape 2*a*. The positioning roller 31 positions the adhesive tape 2*a* pulled out from the adhesive-tape roll 2 in terms of its height and position in the width direction and guides the tape to the bending roller 32.

The bending roller 32 is situated in between the folding mechanism 20 and the positioning roller 31 and rotatably, pivotably coupled to the fixed cover 4. One end 32*a* of the bending roller 32 is situated on the adhesive face 2*a*A of the adhesive tape 2*a*, and contacts and presses against the adhesive face except for part of a predetermined width W2 to be folded. That is, as shown exemplarily in FIG. 2, a circumferential surface 32*b* of the bending roller 32 contacts the adhesive face 2*a*A of the adhesive tape 2*a* pulled out from the adhesive-tape roll 2 over not its entire width but a predetermined part without contacting part of a predetermined width w to be folded. Furthermore, multiple grooves are formed in the circumferential surface 32*b* to reduce the area contacting the adhesive face 2*a*A to prevent the adhesive tape 2*a* from sticking. The side edge of the adhesive tape 2*a* guided by the positioning roller 31 is bent with the end face 32*a* and guided toward the folding mechanism 20. Although in the present embodiment the bending roller 32 is formed in a cylinder, not being limited to this, it may be a disc-like object having a thin circumferential surface that contacts a predetermined position of the adhesive face 2*a*A of the adhesive tape 2*a*.

Moreover, the bending guide block 60 as a non-adhesive face-side member is provided on the back surface of the top plate 5*a* of the open/close cover 5 so as to be opposite the end face 32*a* of the bending roller 32 and contact and press against the non-adhesive face of the side edge 2*a*S of the predetermined width W2 and sandwiches the side edge 2*a*S between the end face 32*a* of the bending roller 32 and itself and bend part of the predetermined width w backward, in order to bend backward the side edge 2*a*S of the predetermined width W2 not contacting the bending roller 32. The bending guide block 60 extends farther toward the folding mechanism 20 than the circumferential surface of the bending roller 32 and has a guide protrusion 62 formed in a triangle at the end thereof which protrusion contacts the non-adhesive face of the side edge 2*a*S bent at about 90° of the adhesive tape 2*a* so as to guide and further bend the side edge 2*a*S to be at a bending angle of about 120°, that is, to form an acute angle of about 60° with the opposite adhesive face.

The folding mechanism 20 as a folding means, as shown in FIGS. 2, 3, 4A, is a folding guide block having a guide portion that contacts and presses against the non-adhesive face of the bent side edge 2*a*S of the adhesive tape 2*a* to bend the side edge 2*a*S to be at about 180°. In the present embodiment, this folding guide block comprises a sloping block 21 as a first guide portion to guide and bend the side edge 2*a*S of the adhesive tape 2*a* to be at a bending angle of about 135° (for the opposite adhesive faces to form an acute angle of about 45°) and a notched block 22 as a second guide portion placed adjacent to the sloping block 21 to guide and further bend such that the bending angle reaches about 180°, and both the blocks 21, 22 are fixed to the fixed cover 4 such that they are disposed on the side faced by the adhesive face below the adhesive tape 2*a* and in the almost middle between the tape holder 11 and the cutter blade 8.

That is, the sloping block 21 has a sloping surface 21*a* making an acute angle of $\alpha$ (≅45°) with the adhesive face 2*a*A of the adhesive tape 2*a* in the tape inserting chamber 15, and is fixed to the fixed cover 4 at an attaching portion 21*b* provided on its one side.

The notched block 22 has a wedge-like notch 23 having a slit-like exit 23*a* slightly larger than the thickness of the adhesive tape 2*a* and an insert entrance 23*b* larger than the slit-like exit 23*a*. The notched block 22 is divided into a top block 22*a* situated above the notch 23 in FIG. 3 and a base block 22*b* situated below in FIG. 3; the top block 22*a* is fixed to the open/close cover 5; and the base block 22*b* integral with the sloping block 21 is fixed to the fixed cover 4.

The sticking means 40 is for sticking together the opposite adhesive faces of the adhesive tape 2*a* having the side edge 2*a*S folded, comprises at least a pair of press members disposed respectively on the side faced by the adhesive face and the other side of the adhesive tape 2*a* having the side edge 2*a*S folded, and is provided in between the folding mechanism 20 and the cutter support 6 as shown in FIGS. 2, 3, 4C. In the first embodiment, the press members are a pair of guide rollers 41, 42, which contact and press against the adhesive tape 2*a* having the side edge 2*a*S folded from both sides.

Of these guide rollers 41, 42, the guide roller 41 situated on the side faced by the non-adhesive face 2*a*B of the adhesive tape 2*a* is rotatably, pivotably coupled to the open/close cover 5, and the guide roller 42 situated on the side faced by the adhesive face 2*a*A of the adhesive tape 2*a* is rotatably, pivotably coupled to the fixed cover 4. Since the guide roller 41 is disposed such that the lower end of its circumferential surface is lower than a line joining the exit 23*a* of the notched block 22 and the guide roller 42, the adhesive tape 2*a* is guided around the guide rollers 41, 42 and its feeding direction is varied such that the adhesive tape 2*a* contacts and presses against both the guide rollers 41, 42. Moreover, multiple grooves are formed in the circumferential surface 42*a* of the guide roller 42 to reduce the area contacting the adhesive face 2*a*A to prevent the adhesive tape 2*a* from sticking.

The open/close cover 5 as an open/close member of the tape cutter 1 is mounted in an openable/closable manner so as to be movable between a closed position where the non-adhesive face-side members coupled to the open/close cover 5 are made to contact and press against the adhesive tape 2*a* inserted through the tape inserting chamber 15 and an open position where the non-adhesive face-side members are not, and in the open position, the non-adhesive face-side members are apart from the adhesive face-side members so that the inserting path for the adhesive tape 2*a* is exposed open over its entire length. Furthermore, the open/close cover 5 is opened and closed by being pivoted sideways relative to the inserting direction.

That is, in the present embodiment, as shown in FIG. 5, the open/close cover 5 is pivotably coupled at its lower end to the base 3 via a hinge 5*b*, and by opening the open/close cover 5 sideways, the non-adhesive face-side members supported by the open/close cover 5 such as the top block 22*a*, the positioning roller 31, the bending guide block 60, and the guide roller 41 are rotated away from the adhesive face-side members such as the bending roller 32, the sloping block 21, the base block 22*b*, and the guide roller 42. That is, by opening the open/close cover 5, the top block 22*a*, the positioning roller 31, the bending guide block 60, and the guide roller 41 are away from the adhesive tape 2*a*, so that the inserting path for the adhesive tape 2*a* is exposed open over its entire length.

Hence, for example, when exchanging the adhesive-tape roll 2 held by the tape holder 11 with a new one, by opening the open/close cover 5, the distances between the non-adhesive face-side members such as the top block 22*a*, the positioning roller 31, the bending guide block 60, and the guide roller 41 and the adhesive face-side members such as the bending roller 32, the sloping block 21, the base block 22*b*, and the guide roller 42 become larger. Then, after attaching the adhesive-tape roll 2 to the tape holder 11, the adhesive tape 2*a* is pulled out until its leading end reaches the cutter blade 8, and by placing the pulled-out adhesive tape 2*a* above the bending roller 32, the sloping block 21, the base block 22*b*, and the guide roller 42 for insertion and then closing the open/close cover 5, the exchange of adhesive-tape rolls 2 and the loading of the adhesive tape 2*a* into the double-portion forming means 16 is finished. Note that the open/close cover 5 is kept closed by a magnet unit 17 on the base 3 magnetically attracting and contacting a metal plate 17*a* fixed to its inner surface.

As such, of the members forming the double-portion forming means 16, the top block 22*a*, the positioning roller 31, the bending guide block 60, and the guide roller 41, which are situated on the side faced by the non-adhesive face 2*a*B of the adhesive tape 2*a*, are fixed to the open/close cover 5, and by opening the open/close cover 5, these members are away from the bending roller 32, the sloping block 21, the base block 22*b*, and the guide roller 42, which are situated on the side faced by the adhesive face 2*a*A of the adhesive tape 2*a*, of the members forming the double-portion forming means 16. Thus, the loading of the adhesive tape 2*a* into the double-portion forming means 16 can be easily performed.

Figure 6:
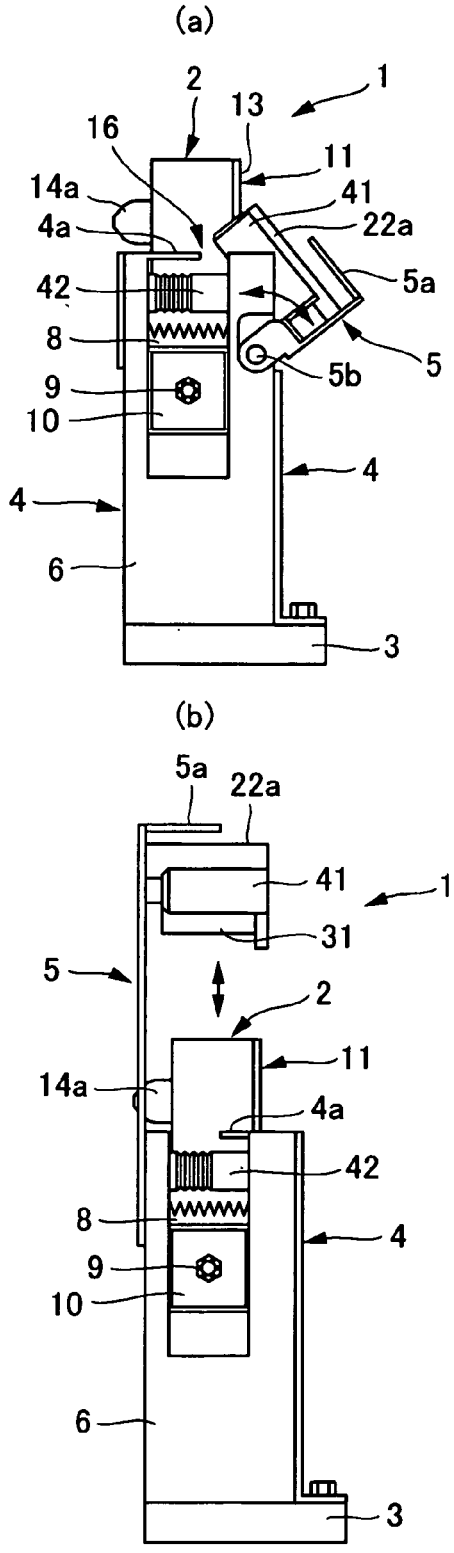
FIGS. 6A, 6B are front views showing variations on the open/close cover of FIG. 5.

Although in the present embodiment the open/close cover 5 is opened/closed about the hinge 5*b* provided on the base 3, not being limited to this, as shown in FIG. 6A, a hinge 5*b* may be provided on the fixed cover 4 on the right side of the Figure at a higher position than is shown in FIG. 5, and thereby the radii of the top block 22*a*, the positioning roller 31, the bending guide block 60, the guide roller 41 and the like are set smaller. Alternatively, as shown in FIG. 6B, an open/close cover 5 may slide upward in the Figure thereby vertically moving the top block 22*a*, the positioning roller 31, the bending guide block 60, the guide roller 41 and the like away from the non-adhesive face 2*a*B of the adhesive tape 2*a*, or any other open/close method can be used in which the members situated on the side faced by the non-adhesive face 2*a*B of the adhesive tape 2*a* together with the open/close cover 5 move away from the members situated on the side faced by the adhesive face 2*a*A of the adhesive tape 2*a*.

An intermediate position setting member (not shown) for holding the open/close cover 5 in an intermediate position where its angle is smaller than in a full-open position shown in the Figure is provided on the tape cutter 1. When the open/close cover 5 is held in the intermediate position, the distances between the top block 22*a*, the positioning roller 31, the bending guide block 60, the guide roller 41 and the bending roller 32, the sloping block 21, the base block 22*b*, the guide roller 42 become slightly larger than those when the open/close cover 5 is fully closed. In this state the setting of the adhesive tape 2*a* in the double-portion forming means 16 is not complete, that is, the double-portion forming means 16 does not perform its intended function.

Next, cutting the adhesive tape 2*a* with the tape cutter 1 will be described.

First, the adhesive-tape roll 2 held on the tape holder 11 is housed in the tape housing section 7. Then, the open/close cover 5 is opened; the adhesive tape 2*a* pulled out from the adhesive-tape roll 2 is loaded into the double-portion forming means 16; and after its leading end is positioned on the cutter blade 8, the open/close cover 5 is closed.

Then, the leading end of the adhesive tape 2*a* is held with the tips of the fingers and the adhesive tape 2*a* is pulled out from the adhesive-tape roll 2.

At this time, as shown in FIG. 4A, the sloping surface 21*a* of the sloping block 21 is disposed to contact the non-adhesive face 2*a*B of the one side edge of the adhesive tape 2*a*, and the side edge of the adhesive tape 2*a* is bent at an acute angle in a direction that the adhesive face 2*a*A is facing.

In the notched block 22, the adhesive tape 2*a* bent by the sloping block 21 is inserted through the insert entrance 23*b*, and as it goes through the notch 23, increasingly bent up to a degree that opposite adhesive face 2*a*A parts are almost parallel at the exit 23*a* slightly larger than the thickness of the adhesive tape 2*a*. Thereby, a continuous double-portion 50 with the adhesive face 2*a*A inside is formed at one side edge of the adhesive tape 2*a* output from the exit 23*a*.

The size of the double-portion 50 formed by the folding mechanism 20 is restricted by the bending roller 32 to a predetermined size. That is, since the circumference of the end face 32*a* of the bending roller 32 is positioned on the adhesive face 2*a*A as shown in FIG. 4B, part of the adhesive tape 2*a* farther than the end face 32*a* is prevented from being bent, thus keeping the size of the double-portion 50 constant.

Moreover, the size of the double-portion 50 restricted by the bending roller 32 varies depending on the width-direction position relationship between the adhesive tape 2*a* and the bending roller 32. Hence, in the tape cutter 1, the positioning roller 31, which guides the adhesive tape 2*a* to the bending roller 32, restricts the adhesive tape 2*a* in width-direction position. That is, although the tension occurring while the double-portion 50 is being formed attempts to move the side end of the adhesive tape 2*a* that contacts the flange 31*b* of the positioning roller 31 toward the double-portion 50, i.e., to the upper right in FIG. 4B, the side end of the adhesive tape 2*a* is restricted in movement by contacting the flange 31*b* of the positioning roller 31. Thus, the width-direction position of the adhesive tape 2*a* is always kept constant.

Figure 7:
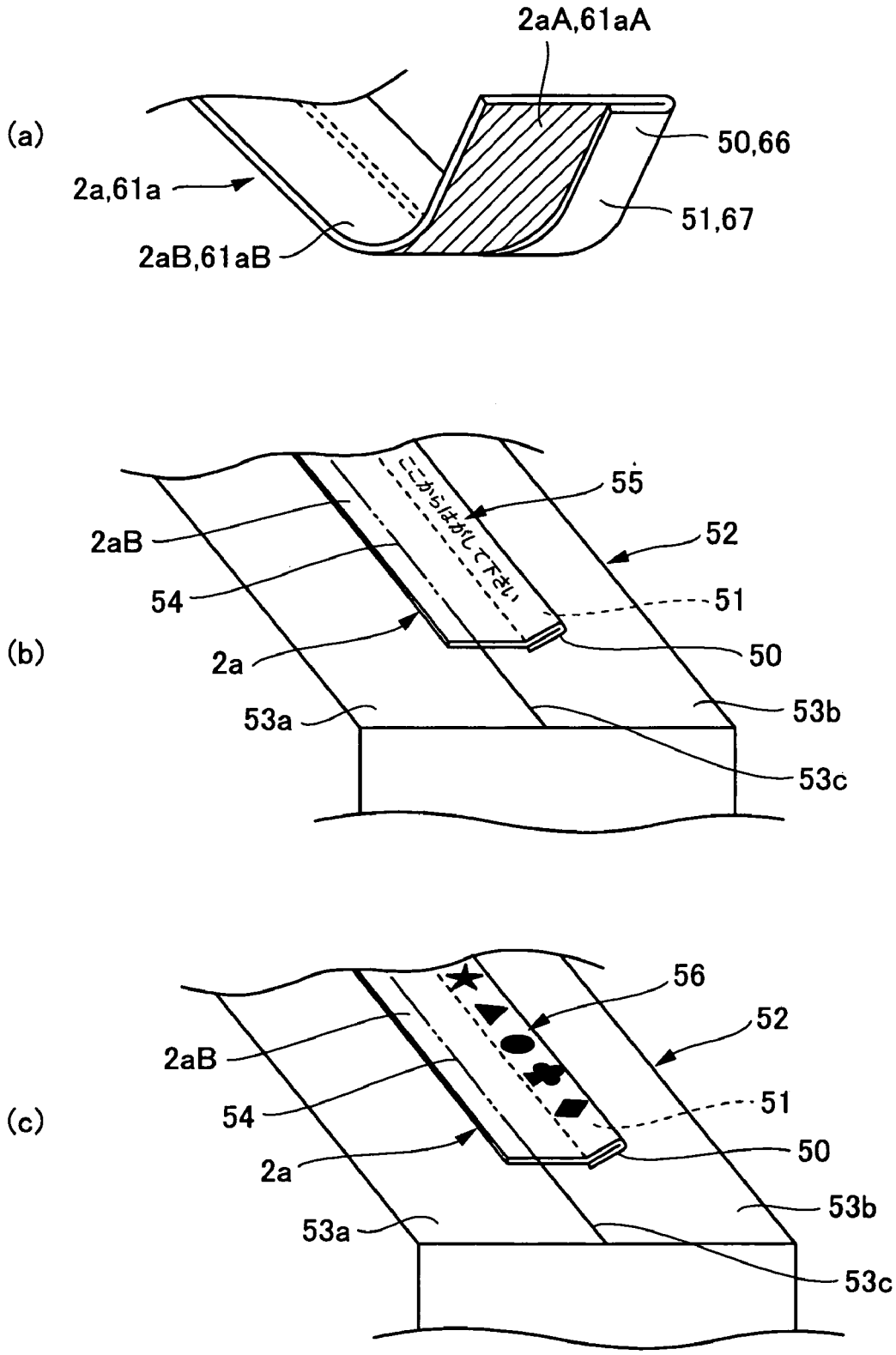
FIG. 7A is a detailed perspective view of adhesive tape having a non-adhesive portion formed.
FIGS. 7B, 7C are perspective views showing the adhesive tape in a stuck state.

The feeding direction of the adhesive tape 2*a* having the double-portion 50 formed by the folding mechanism 20 can be varied by the guide rollers 41, 42 as shown in FIG. 4C. At this time, the opposite adhesive face 2*a*A parts in the double-portion 50 of the adhesive tape 2*a* are pressed against each other by the tension that the adhesive tape 2*a* gives to the guide rollers 41, 42, and thus, the one side edge 2*a*S of the adhesive tape 2*a* is folded to form a double, non-adhesive portion 51 as shown in FIG. 7A.

This series of steps are consecutively performed by continuously pulling out the adhesive tape 2*a* from the adhesive-tape roll 2. When an adhesive tape 2*a* piece of a desired length has been pulled out, the adhesive tape 2*a* piece is cut off by pressing the adhesive tape 2*a* against the cutter blade 8.

In this way, by using the tape cutter 1, the non-adhesive portion 51 can be formed at one side edge of the adhesive face 2*a*A of the adhesive tape 2*a*, and thus the adhesive tape 2*a* piece, which is to be easily removed, can be cut off. That is, when the adhesive tape 2*a* is stuck to lids 53*a*, 53*b* of a box 52 for enclosing as shown in FIG. 7B, the one side edge thereof is not sticking to the surface, and thus the tape can be easily removed when holding this.

However, with the adhesive tape 2*a* having the non-adhesive portion 51 formed, a worker cannot recognize the lateral center of the adhesive face 2*a*A from the side faced by the non-adhesive face 2*a*B. Hence, the sticking needs to be performed confirming the size of the adhesive face 2*a*A, and thus it may be difficult to stick the adhesive tape 2*a* to an appropriate position. Accordingly, a chain line 54 is printed as a mark indicating an approximate lateral center of the adhesive face 2*a*A with the non-adhesive portion 51 beside it on the non-adhesive face 2*a*B of the adhesive tape 2*a* of the adhesive-tape roll 2 mounted on the tape cutter 1. That is, a means indicating information about the adhesive area width after the side edge 2*a*S of the adhesive tape 2*a* is folded is marked along the longitudinal direction at a distance inward from the side edge 2*a*S on the non-adhesive face not coated with an adhesive.

Thus, when the adhesive tape 2*a* is stuck to the lids 53*a*, 53*b* for enclosing, by making the chain line 54 coincide with a boundary 53*c* between the lids 53*a* and 53*b*, the approximate lateral center of the adhesive face 2*a*A coincides with the boundary 53*c* between the lids 53*a* and 53*b*, thus facilitating the sticking. Moreover, characters 55 as shown in FIG. 7B or icons 56 as shown in FIG. 7C that indicates the presence of the non-adhesive portion 51 may be printed on the non-adhesive face 2*a*B of the adhesive tape 2*a*. Although in the present embodiment the chain line 54 is used as a mark indicating an approximate lateral center of the adhesive face 2*a*A, not being limited to this, any mark can be used by which an approximate lateral center of the adhesive face 2*a*A can be recognized from the side faced by the non-adhesive face 2*a*B, such as a solid line, a dashed line or coloring differently opposite sides of the approximate lateral center of the adhesive face 2*a*A. Although the characters 55 or the icons 56 are printed on the non-adhesive face 2*a*B to indicate the presence of the non-adhesive portion 51, not being limited to this, other icons or symbols may be used to indicate the presence of the non-adhesive portion 51.

Furthermore, when the open/close cover 5 is held in the intermediate position, the tape cutter 1 can cut a usual adhesive tape without the non-adhesive portion 51. That is, when the open/close cover 5 is held in the intermediate position, the distances between the top block 22*a*, the positioning roller 31, the guide roller 41 and the bending roller 32, the sloping block 21, the base block 22*b*, the guide roller 42 are slightly larger than those when the open/close cover 5 is fully closed. Hence, the adhesive tape 2*a* is not completely loaded in the double-portion forming means 16, so that the non-adhesive portion 51 is not formed on the adhesive tape 2*a*.

As such, the open/close cover 5 can be held in the intermediate position, and by allowing the open/close cover 5 to switch between the fully-closed position and the intermediate position, the tape cutter 1 can cut usual adhesive tape without the non-adhesive portion 51 and adhesive tape with the non-adhesive portion 51, thus increasing its versatility.

Second Embodiment

Figure 8:
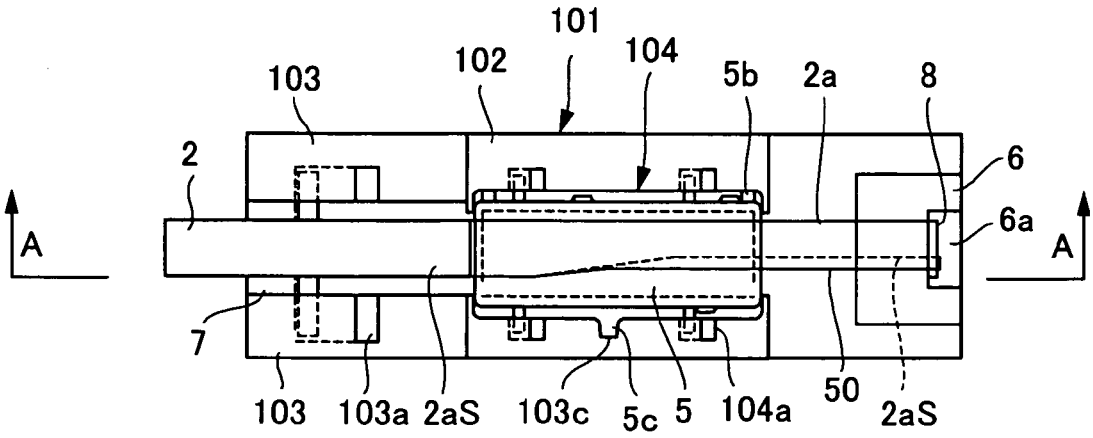
FIG. 8 is a plan view illustrating an adhesive tape cutter according to a second embodiment of the present invention.
Figure 9:
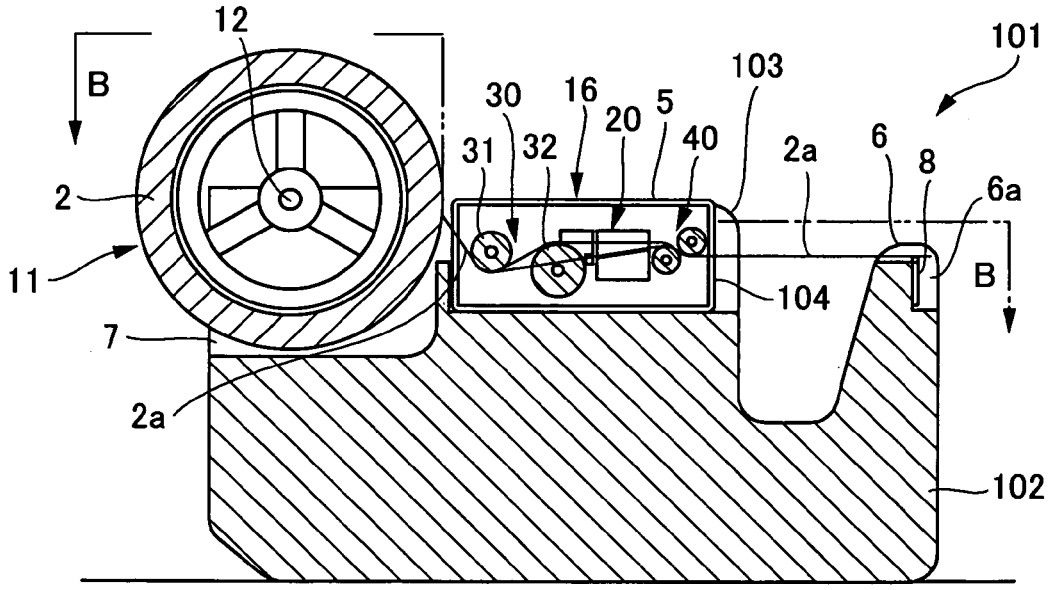
FIG. 9 is a side sectional view along line A-A of FIG. 8.
Figure 10:
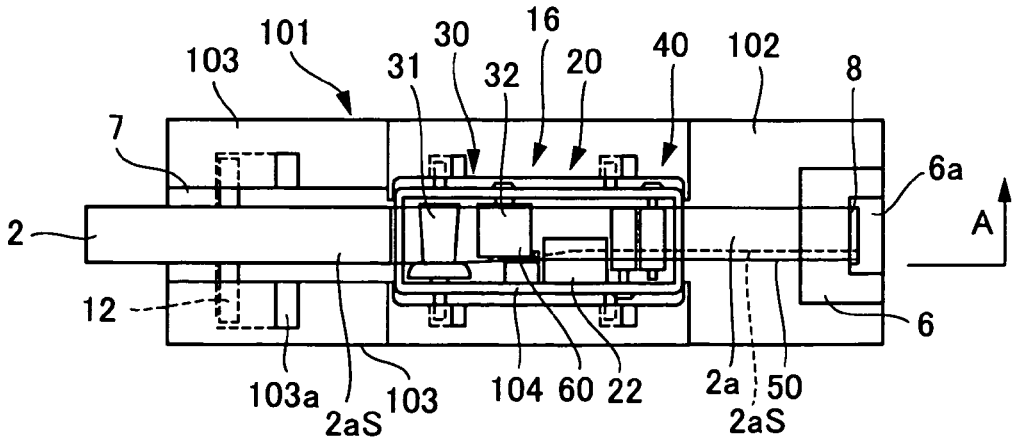
FIG. 10 is a plan view along line B-B of FIG. 9.
Figure 11:
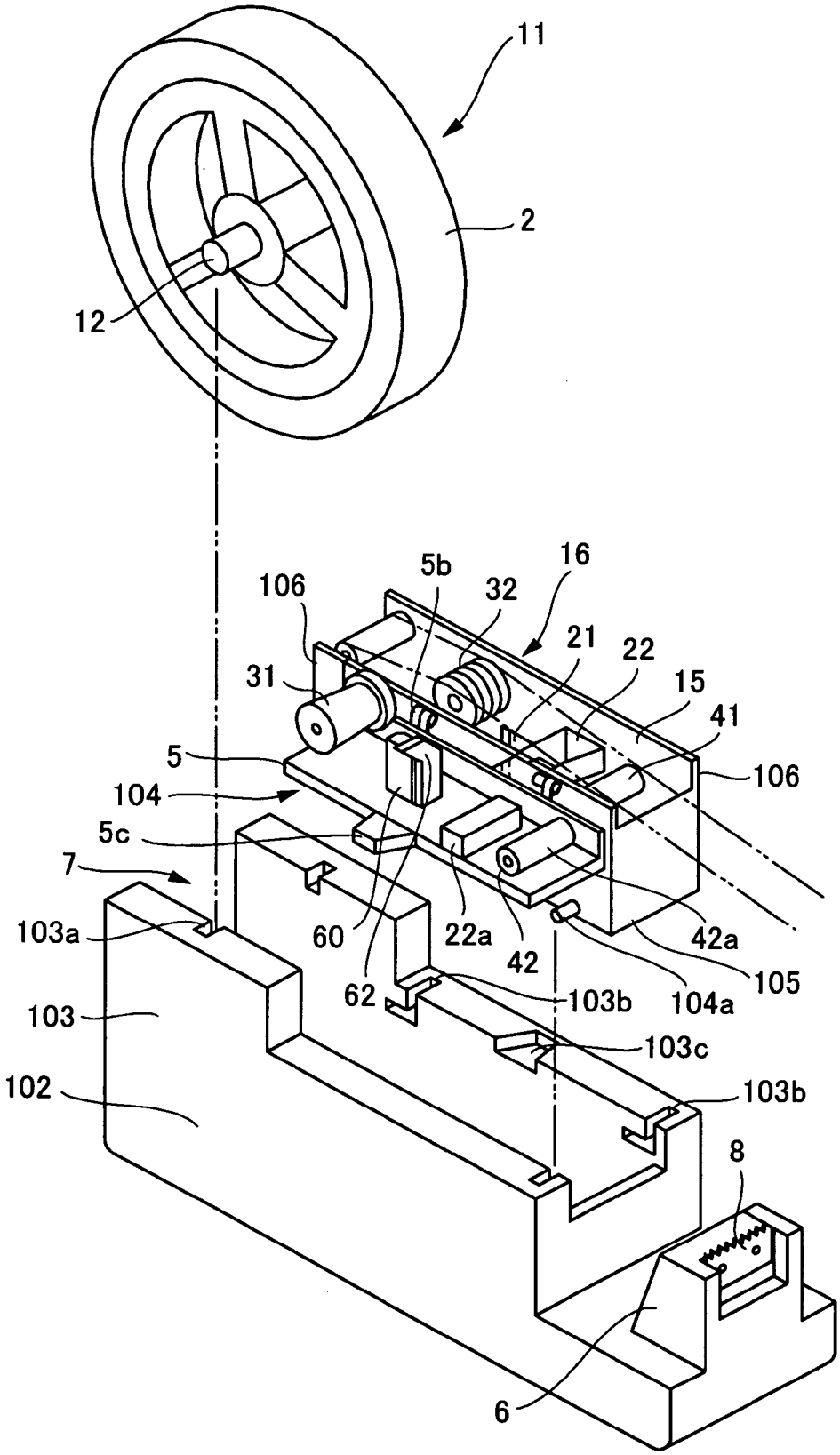
FIG. 11 is a general perspective view when the open/close cover is open.
Figure 12:
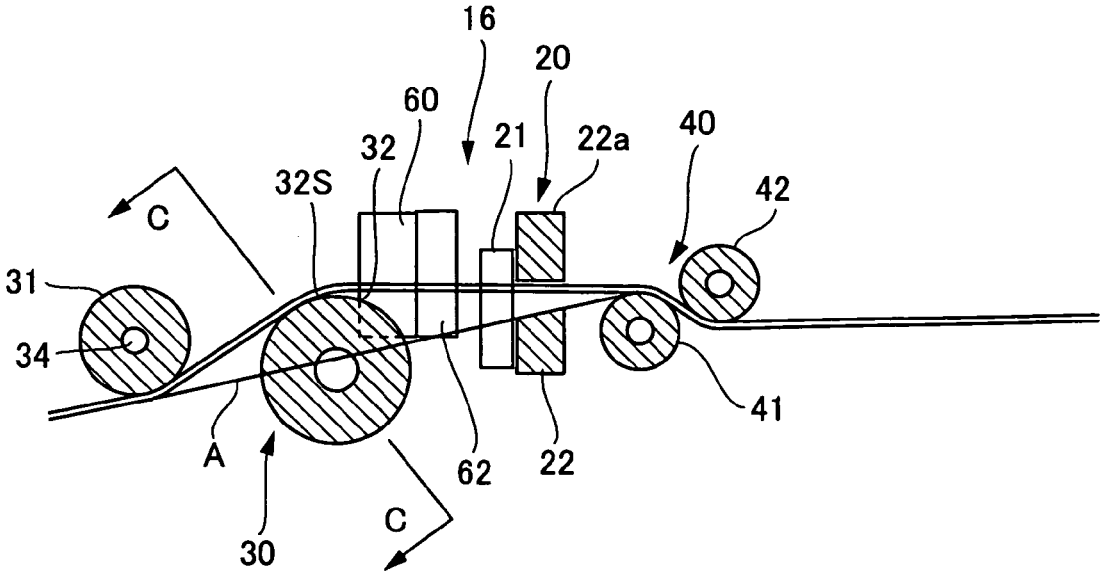
FIG. 12 is a sectional view showing in detail a mutual position relationship between a positioning roller, a bending roller, a folding means, and a pair of guide rollers as a sticking means.

FIGS. 8 to 11 show a second embodiment of the present invention; FIG. 8 is a plan view thereof; FIG. 9 is a side sectional view along line A-A of FIG. 8; FIG. 10 is a plan view along line B-B of FIG. 9; and FIG. 11 is a general perspective view when its open/close cover is opened. And FIG. 12 is a detailed sectional view showing a mutual position relationship between a bending mechanism 30, a folding mechanism 20, and a sticking means 40.

In the second embodiment, the essential configuration thereof is the same as in the first embodiment, and the same reference numerals indicate the same or like parts as in the first embodiment, and a description thereof is omitted. A tape cutter 101 has a resin-made main body 102 formed in a substantially rectangular solid, and a cutter support 6 is formed integrally with the main body 102 on one side in its longitudinal direction, and a tape housing section 7 is provided on the other side.

As shown in FIGS. 8 to 12, a cut 6*a* open upwards is made in the cutter support 6, and a cutter blade 8 is mounted in the cut 6*a*. The cutter blade 8 is fixed to the cutter support 6 such that the blade end faces upwards.

The tape housing section 7 is formed by vertical side walls 103 formed integrally with the main body 102 on its opposite sides along the longitudinal direction, and an adhesive-tape roll 2 held by a tape holder 11 as a tape support is housed in the tape housing section 7. The tape holder 11 is a resin-made rotation wheel, at whose rotation center a holder shaft 12 is formed integrally therewith and loosely fitted and rotatably held in mounting cuts 103*a* made in the side walls 103.

Provided between the cutter support 6 and the tape housing section 7 is a double-portion forming means 16 which comprises a bending mechanism 30 that bends one longitudinal side edge 2*a*S of the pulled-out adhesive tape 2*a* backward or downward at an angle of about 90°, a folding mechanism 20 that further bends the bent side edge 2*a*S to be at about 180° so that the adhesive faces are facing each other, and a sticking means 40 that sticks the opposite adhesive faces together.

The double-portion forming means 16 is mounted on a cassette-type holder 104 that is attachably, detachably provided to the main body 102. This cassette-type holder 104 is formed in a rectangular solid, and comprises a base 105, opposite side walls 106 formed vertically on opposite sides of the base 105 along the longitudinal direction, and an open/close cover 5 provided between the tops of the opposite side walls. A tape inserting chamber 15 is enclosed and formed by the side walls 106 and the open/close cover 5. The open/close cover 5 is pivotably coupled to the top of one of the side walls via a pivot pin such as a hinge 5*b* or a joint as shown in FIG. 11, and the open/close cover 5 is opened and closed by being pivoted through 180° sideways relative to the inserting direction for the adhesive tape 2*a*. Note that the open/close cover may be coupled so as to be slid by a slide mechanism (not shown) or the like.

Cassette attaching rods 104*a* are fixed to the base 105 of the cassette-type holder 104 near its lower end. The cassette attaching rods 104*a* are inserted from above into the vertical cut portion of attachment cuts 103*b* formed like an L-shape in the side walls 103 of the main body and, at the lower end of the vertical cut portion, slid into the lateral cut portion extending toward the adhesive-tape roll 2 and held.

Furthermore, a stopper 5*c* protrudes from the swinging end of the open/close cover 5, and when the cassette-type holder 104 in a state where the open/close cover 5 is closed is attached to the main body 102, the stopper 5*c* fits into a stopper cut 103*c* made through the upper surface of the side walls 103 of the main body 102, and thereby the cassette-type holder 104 is fastened to the main body 102.

The double-portion forming means 16 provided on the cassette-type holder 104 has essentially the same configuration as in the first embodiment. That is, the bending mechanism 30 comprises the bending guide block 60 as well as the bending roller 32. The bending guide block 60, as a non-adhesive face-side member, is fixed to the open/close cover 5 and, in a closed position, faces an end face of the bending roller 32 and contacts and presses against the non-adhesive face of the side edge 2*a*S not contacting the bending roller 32, to sandwich the side edge 2*a*S between the end face 32*a* of the bending roller 32 and itself and bend the side edge 2*a*S of a predetermined width backward to be at about 90°. The bending guide block 60 extends farther toward the folding mechanism 20 than the circumferential surface of the bending roller 32 and has a guide protrusion 62 formed in a triangle at the end thereof which protrusion contacts the non-adhesive face of the side edge 2*a*S bent at an angle of about 90° of the adhesive tape 2*a* so as to further bend the side edge 2*a*S to be at a bending angle of about 120°, that is, to form an acute angle of about 60° with the opposite adhesive face.

The folding mechanism 20 comprises a sloping block 21 as a first guide portion to guide and bend the side edge 2*a*S of the adhesive tape 2*a* to be at a bending angle of about 135°, that is, for the opposite adhesive faces to form an acute angle of about 45° and a notched block 22 as a second guide portion placed adjacent to the sloping block 21 to further bend such that the bending angle reaches about 180°. The configuration thereof is the same as in the first embodiment, and the sloping block 21 and the notched block 22 are fixed to one of the side walls 106 of the cassette-type holder 104.

Also, the sticking means 40, as in the first embodiment, is constituted by a pair of guide rollers 41, 42, which contact and press against the adhesive tape 2*a* having the side edge 2*a*S folded from both sides to stick together the opposite adhesive faces to form a double portion.

Of these guide rollers 41, 42, the guide roller 41 situated on the side faced by the non-adhesive face 2*a*B of the adhesive tape 2*a* is rotatably, pivotably coupled to the open/close cover 5, and the guide roller 42 situated on the side faced by the adhesive face 2*a*A of the adhesive tape 2*a* is rotatably, pivotably coupled to one of the side walls 106 of the cassette-type holder 104. Since the guide roller 41 on the side faced by the non-adhesive face is disposed such that the lower end of its circumferential surface is lower than a line joining the exit 23*a* of the notched block 22 and the guide roller 42, the adhesive tape 2*a* is guided around the guide rollers 41, 42 and its feeding direction is varied such that the adhesive tape 2*a* contacts and presses against both the guide rollers 41, 42. Moreover, multiple grooves are formed in the circumferential surface 42*a* of the guide roller 42 to reduce the area contacting the adhesive face 2*a*A to prevent the adhesive tape 2*a* from sticking. Here, the guide roller 41 on the side faced by the non-adhesive face is disposed downstream of the guide roller 42 in the direction that the adhesive tape 2*a* is pulled out, which positional relationship is opposite to that of the first embodiment in terms of front/back.

With this configuration, the process from bending the side edge 2*a*S to folding it can be stably performed by the tension acting on the adhesive tape 2*a*, and the side end 2*c* of the adhesive tape 2*a* can be folded substantially along a straight line A by the tension acting on the adhesive tape.

Figure 13:
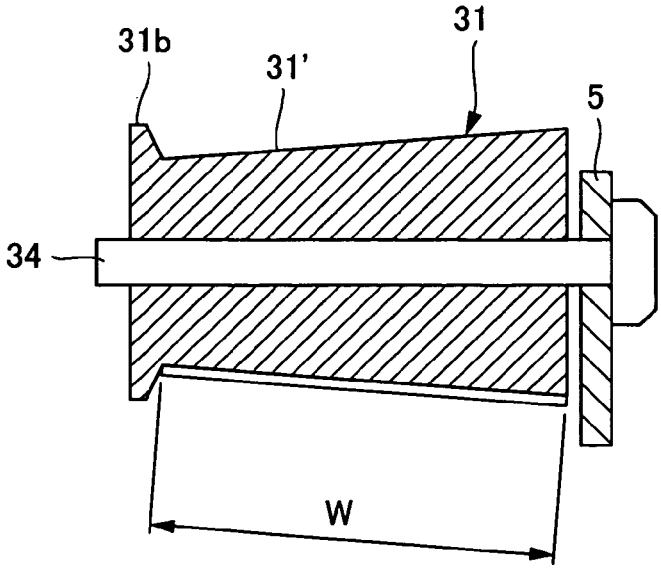
FIG. 13 is a sectional view showing the positioning roller.

FIG. 13 is a sectional view showing the positioning roller 31. In the second embodiment, a taper roller 31' is used as the positioning roller 31, and the taper roller 31' is rotatably supported by a support shaft 34 provided at its center and fixed to the open/close cover 5. The taper roller 31' is tapered to a flange 31*b* at its one end, and the tension acting on the adhesive tape 2*a* slides the adhesive tape 2*a* to the smaller diameter side of the taper roller 31', but the side edge 2*a*S contacts the flange 31*b*, thereby preventing the further lateral movement. In this way, the adhesive tape 2*a* is positioned in the width direction. This positioning stably keeps the folded portion width of the adhesive tape at an accurate size.

Figure 14:
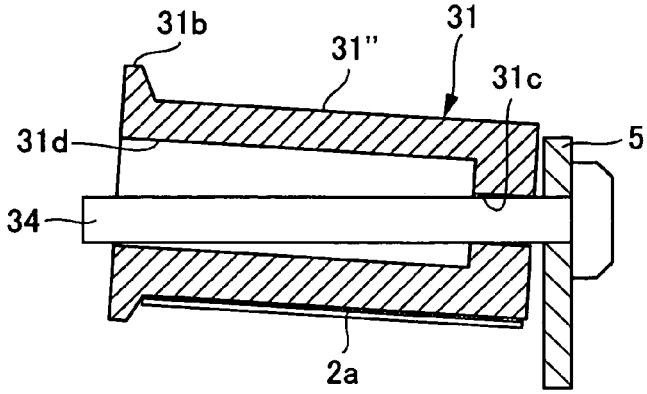
FIG. 14 shows a variation on the positioning roller.

FIG. 14 shows a variation on the positioning roller 31, and in this variation, a tilting roller 31" is used. The tilting roller 31" is tilted by the tension of the adhesive tape 2*a*, and is loosely supported by a support shaft 34 fixed to the open/close cover 5. That is, the tilting roller 31" is formed in a bottomed cylinder where an opening 31*c* slightly larger than the diameter of the support shaft 34 is formed in its end corresponding to the base end of the support shaft 34 and an opening 31*d* of a large diameter is made in the other end. Hence, the tilting roller 23 can tilt by an amount corresponding to the clearance between the opening 31*c* and the support shaft 34, and the tension acting on the adhesive tape 2*a* when pulled out slides the adhesive tape 2*a* to the end of the roller, so that the side edge 2*a*S contacts the flange 31*b*, thereby positioning the tape in the width direction.

Figure 15:
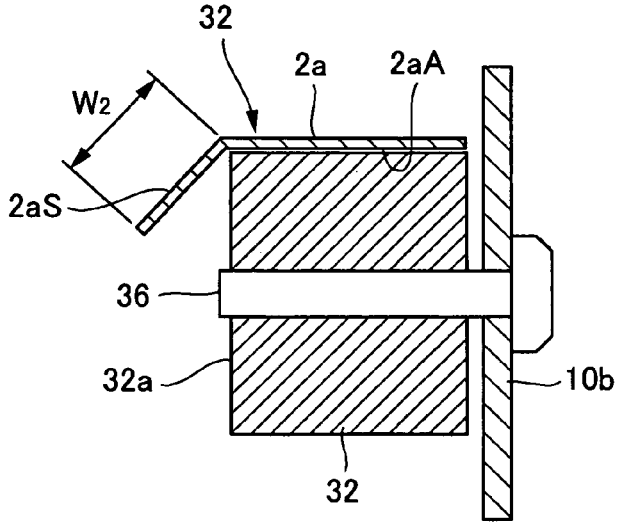
FIG. 15 is a sectional view showing the bending roller.

FIG. 15 is a sectional view showing the bending roller 32. In this example, the bending roller 32 is formed in a simple cylinder, but is covered with an adhesive-resistant material such as Teflon™ resin to prevent the adhesive face of the adhesive tape 2*a* from sticking to it. And the bending roller 32 is rotatably supported by a support shaft 36 provided at its center, which is fixed to one of the side walls 106 of the cassette-type holder 104.

Figure 16:
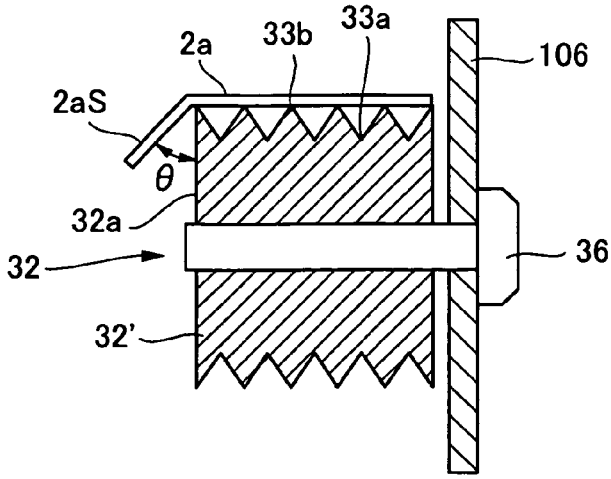
FIG. 16 is a sectional view of a variation on the bending roller.

FIG. 16 shows a variation on the bending roller 32. In this variation, a grooved roller 32' is used. The grooved roller 32' has a plurality of parallel annular V-shaped grooves 33*a* provided on its circumferential surface, and since only tips 33*b* contact the adhesive tape 2*a*, the sticking area is small and thus it is hard to stick.

The function and operation of the tape cutter 101 according to the second embodiment will be described below using the grooved roller 32' as an implementation.

Figure 17:
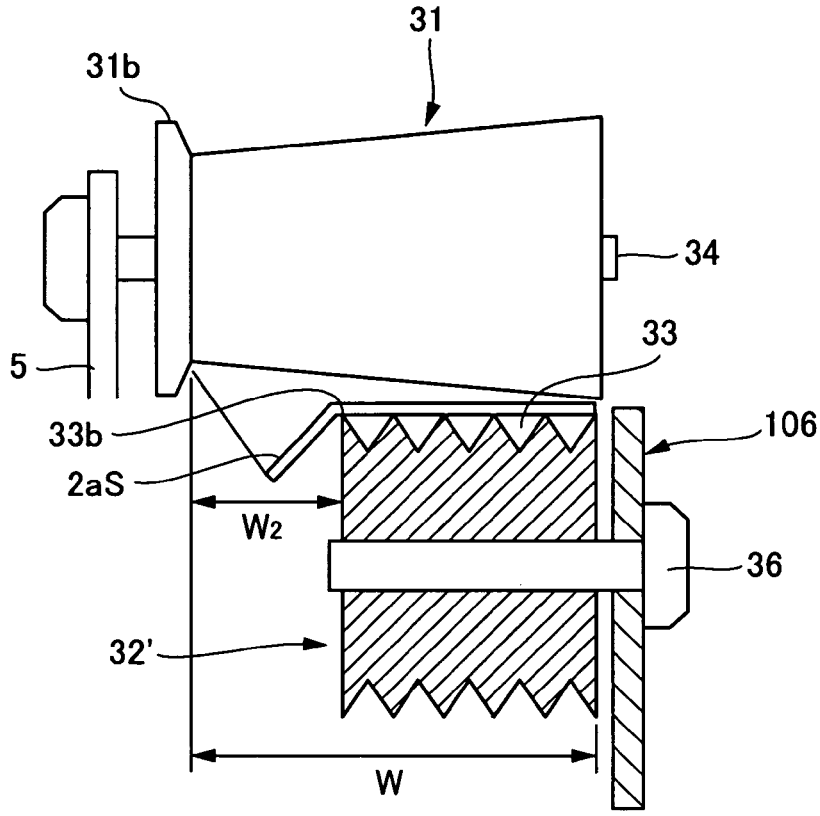
FIG. 17 is a sectional view along line C-C of FIG. 12.
Figure 18:
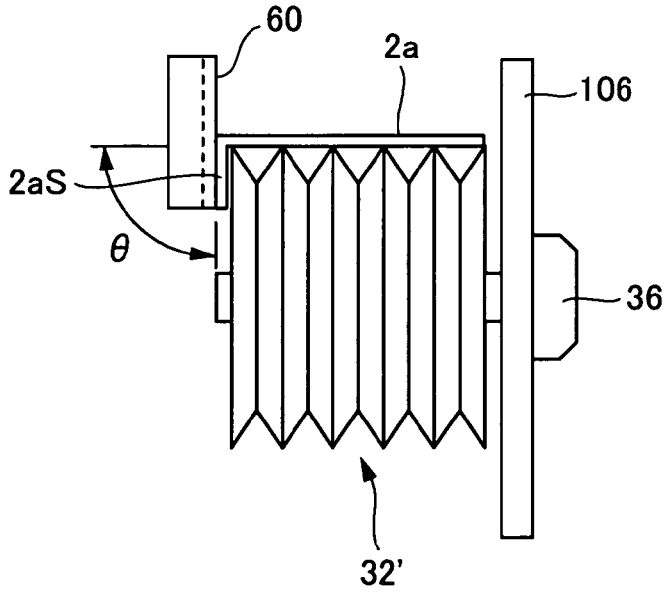
FIG. 18 is a front view showing the bending roller and a bending guide block.
Figure 19:
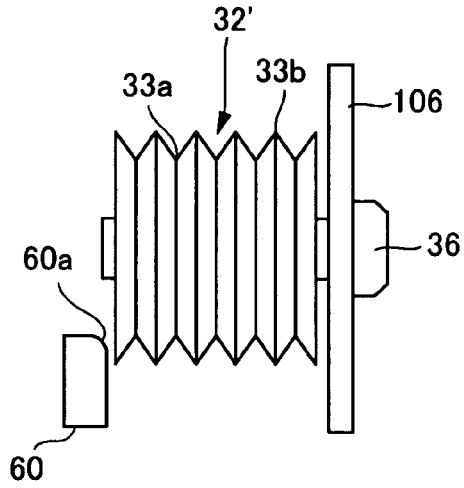
FIG. 19 is a plan view showing the bending roller and the bending guide block.
Figure 20:
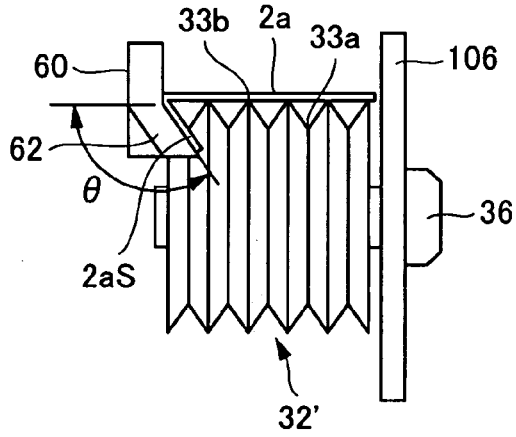
FIG. 20 is a front view showing the bending roller and a guide protrusion of the bending guide block.
Figure 21:
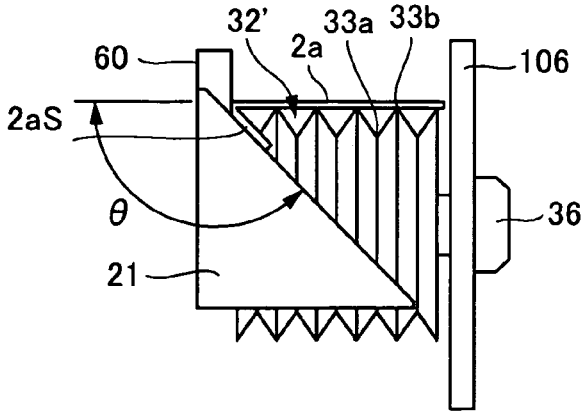
FIG. 21 is a front view showing a sloping block as a first guide portion of the folding mechanism.
Figure 22:
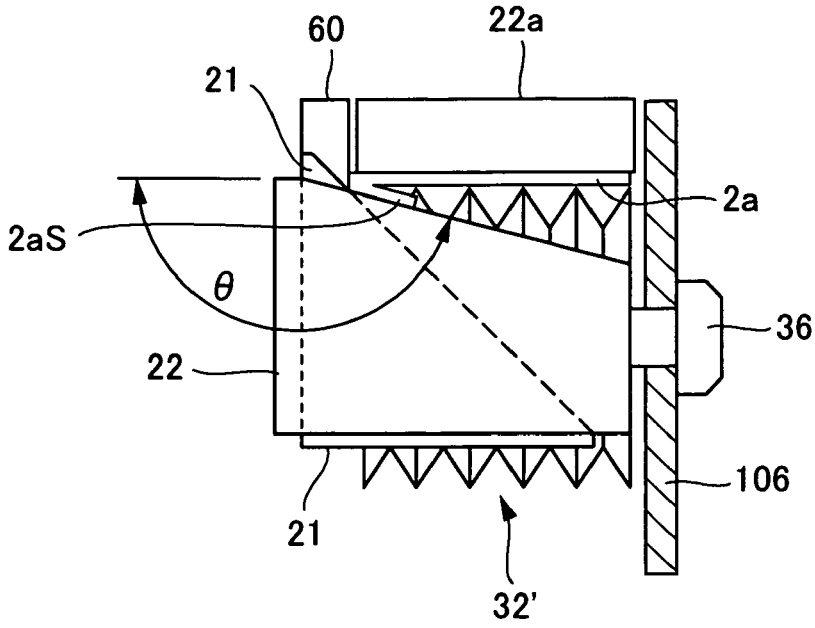
FIG. 22 is a front view showing a notched block as a second guide portion of the folding mechanism.

FIG. 17 is a sectional view along line C-C of FIG. 12. As shown in the Figure, the width W2 of the side edge 2*a*S to be folded of the adhesive tape 2*a* is decided by a positional relationship between the end face 32*a* and the flange 31*b* at the end of the positioning roller 31, that is, the distance in the tape-width direction from the flange 31*b* to the end face 32*a*. Accordingly, the distance W2 is set at a desired, predetermined width.

Here, the inventors confirmed the following by experiment. If the folded width W2 is too small, stable folding of the adhesive tape 2*a* is difficult due to the spring-back action thereof. Also, as to the tension, if too strong, the adhesive tape will be cut, and on the other hand, if too weak, the adhesive tape becomes slack and tangled. That is, the folded width W2 has a minimum limit in practice, and also the tension has an appropriate range.

That is, the side edge 2*a*S of the adhesive tape 2*a*, which does not contact and press against the bending roller 32, is shorter in path length than the other tape portion extending from a tape contact point 31*s* through a tape contact point 32*s* to a tape contact point 41*s* and contacting and pressing against the bending roller 32 as shown in FIG. 12, and hence becomes slack to a degree corresponding to the difference in path length. The slackness is affected by the angle to the tape and the external diameter of the bending roller 32 and the tension but usually is cancelled out by the extension of the adhesive tape 2*a*. However, if the folded width W2 is too large, the slackness cannot be cancelled out, so that the adhesive tape 2*a* becomes slack. As such, it was confirmed that the width W2 has an upper limit.

Furthermore, while the folded, double-portion 50 is for persons removing the adhesive tape with their nails or finger tips, as to the sizes of finger tips of persons including children and adults, the index finger is from 8 to 18 mm in width and from 7 to 14 mm in thickness at the middle of its nail according to medical statistics. It is found that, from the point of view of human engineering, the folded width W2 of the double-portion 50 easy to remove needs to be at least 1.5 mm and that as the width becomes larger, easiness to remove rapidly increases. Moreover, if the folded width W2 is at 25 mm or larger, easiness to remove is not further improved, and hence it is not economical. As such, it is found by experiment that in order to bring out enough of its desirable function, understanding a ratio relationship between the tape width and distances L and M is needed and that desirably the minimum of the width W2 is at least 1.5 mm and its maximum is 25 mm or less because of the above-mentioned occurrence of slackness and economic effect.

Table 1 shows results of the removal experiment where removal of a cellophane tape by a panel of 35 adults is performed and statistics on the number of answers for each degree of easiness to remove are obtained. The degree of easiness to remove for each value of the folded width W2 from this experiment is shown in the following table.

TABLE 1

| | Degree of easiness to remove Number of answers out of 35 panelists | | | |
|---|---|---|---|---|
| Folded width W2 | Cannot be removed | Hard to remove | Can be removed | Easy to remove |
| 1.0 | 34 | 1 | 0 | 0 |
| 1.2 | 31 | 4 | 0 | 0 |
| 1.5 | 8 | 12 | 15 | 0 |
| 2.0 | 5 | 14 | 16 | 0 |
| 2.5 | 2 | 14 | 19 | 0 |
| 3.0 | 0 | 3 | 12 | 20 |
| 4.0 | 0 | 1 | 4 | 30 |
| 5.0 | 0 | 1 | 2 | 32 |
| 6.0 | 0 | 0 | 1 | 34 |
| 8.0 | 0 | 0 | 0 | 35 |
| 10.0 | 0 | 0 | 0 | 35 |

As shown in Table 1, for the folded widths W2 of 1.0 and 1.2 mm, 34 and 31, most, of the panelists answered "cannot be removed"; for 1.5 mm, 15 of them answered "can be removed", and the number of ones who answered "hard to remove" added to it makes 27, which is greater than the other.

For larger widths, particularly for the folded width W2 of 3.0 mm, 20 of them answered "easy to remove", and for the width of 5 mm or larger, the number hardly varies.

From this, it is understood that the critical size of the folded width W2 in terms of removal feasibility is at least 1.5 mm and the best is at least 3 mm.

Needless to say, if the width is larger than this, they are easy to remove, but a maximum width of about 25 mm is enough. The width larger than this is not needed from the viewpoint of its function, since it would be wastefully large, and also is not preferable from the viewpoint of economy since cost would be higher.

Next, the bending mechanism 30 for the adhesive tape will be described. As shown in FIGS. 17 to 22, when the adhesive tape 2*a* contacts and presses against the end face 32*a* of the bending roller 32, the side edge 2*a*S not contacting the bending roller 32 is bent by the action of tension backward at the first contact point at a bending angle θ of about 135°±30°.

Then, the bent side edge 2*a*S moves into between the bending guide block 60 downstream of the support shaft 36 of the bending roller 32 and opposite the end face 32*a* and the bending roller 32, and while the non-adhesive side of the side edge 2*a*S is pressed against and guided by the bending guide block 60, the bending angle is further reduced to about 90°.

The bending guide block 60 extending further downstream than the circumferential surface of the bending roller 32 has a guide protrusion 62 formed in a triangle at the end thereof which contacts the non-adhesive face of the side edge 2*a*S bent at about 90° of the adhesive tape 2*a* so as to further bend the side edge 2*a*S to form an acute angle of about 60° with the opposite adhesive face. The side edge 2*a*S contacts and presses against the guide protrusion 62 and is bent at an acute angle of about 60°. The thickness of the bending guide block 60 is set at about 5 to 20 mm, and a corner 60*a* on the entrance side thereof is chamfered or formed like an R so as to make introduction smooth.

Next, the side edge 2*a*S bent at about 60° of the adhesive tape 2*a* contacts and presses at the non-adhesive side against the sloping block 21 as a first guide portion of the folding guide block and is bent by the block 21 at an acute angle of about 45°, and then contacts and presses against the notched block 22 as a second guide portion and is further bent at about 180°.

That is, the bending guide block 60, the guide protrusion 62, the sloping block 21, and the notched block 22 are configured to reduce the bending angle θ of the side edge 2*a*S of the adhesive tape 2*a* by multiple steps to fold it thereby achieving smooth folding.

Of the notched block 22, the top block 22*a* fixed to the open/close cover 5 may be either a guide block having its portion, contacting the adhesive tape, formed like an R or as a slide surface, or a roller. In the case of a roller, frictional resistance decreases and thus the adhesive tape slides smoothly.

Figure 23:
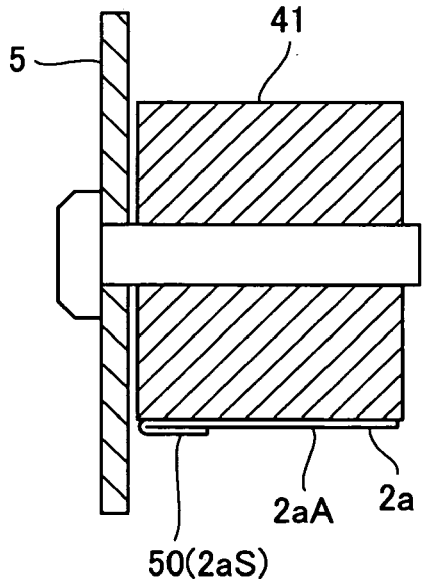
FIG. 23 is a sectional view of a guide roller as a non-adhesive face-side member of the sticking means.

FIG. 23 is a sectional view of the guide roller 41 as a non-adhesive face-side member of the sticking means 40. The sticking means 40 is constituted by the guide roller 42 on the side faced by the adhesive face and the guide roller 41 on the side faced by the non-adhesive face. The guide roller 41 being disposed such that its lowest point is lower than the highest point of the guide roller 42 gives a pressing effect, and presses the opposite adhesive faces of the adhesive tape 2*a* having the side edge 2*a*S folded against each other to stick together completely to form a double portion.

Then, the adhesive tape 2*a* having the double portion 50, the folded side edge 2*a*S, formed as a non-adhesive portion on its side edge is bridged to the cutting section 6 and a piece of a desired length is cut off the tape.

Figure 24:
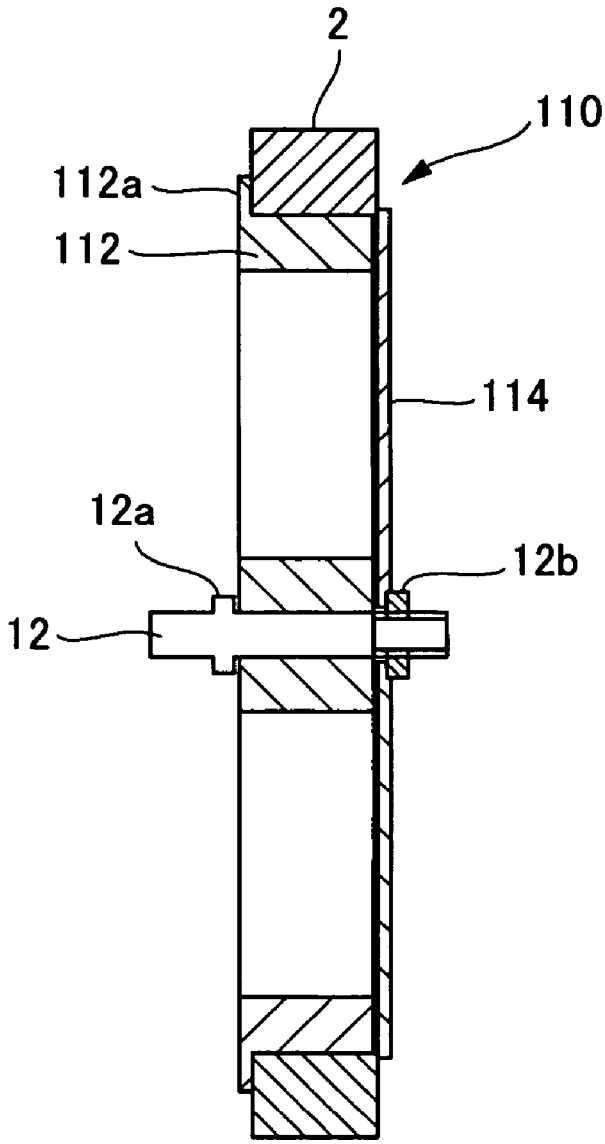
FIG. 24 shows an implementation where a positioning mechanism is incorporated in a tape holder instead of the positioning roller as a positioning means.

FIG. 24 shows an implementation where a positioning mechanism is incorporated in the tape holder 11 instead of the positioning roller as a positioning means. A rotation wheel 110 has a ring flange 112*a* provided on one side in the width direction of its outer ring 112, and one side of the adhesive-tape roll 2 contacts the ring flange 112*a*. Also, a flange 12*a* is provided on the holder shaft 12 and contacts one side of the rotation wheel 110. Thereby, the adhesive-tape roll 2 is positioned by an adjuster 12*b* in the width direction and fixed on one side via a retainer plate 114 to the holder shaft 12. The adjuster 12*b* is fixed to the holder shaft 12 by means of, e.g., a screw or frictional, tight fitting. Thus, the side end position in the width direction of the adhesive tape 2*a* is constant relative to the bending roller 32 all the time.

As such, the loading of the adhesive tape into the adhesive tape cutter is essentially the same as in the first embodiment. That is, the loading is finished by the following simple work. The adhesive-tape roll 2 is fitted into the outer ring 112 of the rotation wheel 110; the rotation wheel 110 is rotatably supported by the tape housing section 7; then the open/close cover 5 of the cassette-type holder 104 is opened and the adhesive tape 2*a* is pulled out from the adhesive-tape roll 2; the end thereof is inserted through the cassette-type holder 104 and attached onto the cutting section 6; thereafter the open/close cover 5 of the cassette-type holder 104 is closed. In the second embodiment, there is provided the bending guide block 60 that is not in the first embodiment, and since the bending guide block 60 is fixed to the open/close cover 5, when the open/close cover 5 is closed, the lower end of the bending guide block 60 contacts and presses against the side edge 2*a*S, not contacting the bending roller 32, from above and bends and sandwiches the side edge 2*a*S between the end face 32*a* of the bending roller 32 and itself. Thus, only by closing the open/close cover 5, the side edge 2*a*S of the adhesive tape 2*a* is automatically inserted into the space between the end face 32*a* of the bending roller 32 and the bending guide block 60.

Moreover, because the bending guide block 60 and the guide protrusion 62 are provided, even if the tension acting on the adhesive tape 2*a* is reduced, the side edge 2*a*S can be folded smoothly, reliably. Hence, with reduced operation force in pulling-out, operability can be improved as much as possible.

In the second embodiment, the double-portion forming means 16 is fixed to the cassette-type holder 104, which is attachable to and detachable from the tape cutter main body 102. The main body is common with a conventional tape cutter without the double-portion forming means 16, and thus production cost can be reduced as much as possible.

Although detailed description and figures are omitted, in order to form double portions as non-adhesive portions on both side edges of adhesive tape, a pair of double-portion forming means may be provided to fold both side edges of the adhesive tape to form double portions. By forming double portions on both side edges of the adhesive tape, easiness to remove the adhesive tape is further improved, and such forming means is suitable particularly for use in a tape cutter for broad adhesive tapes.

Third Embodiment

Figure 25:
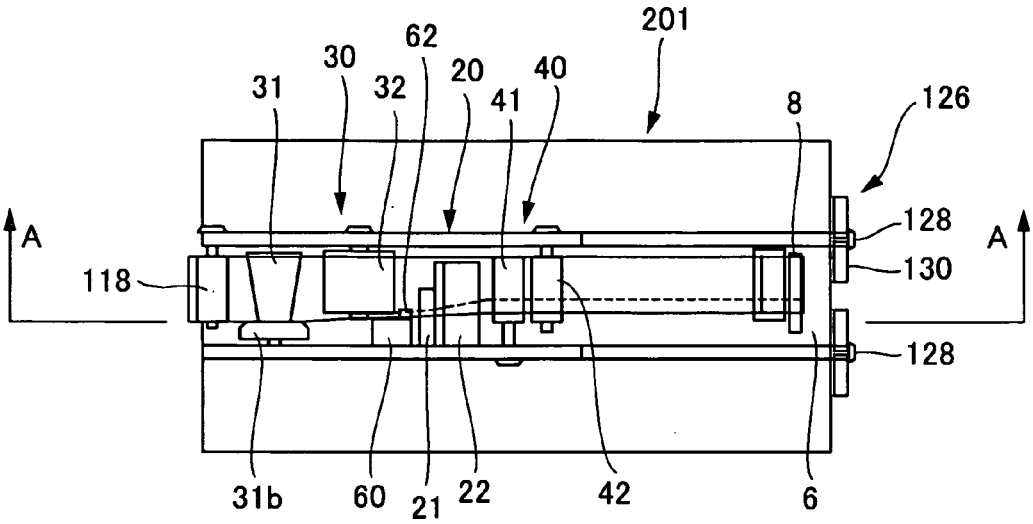
FIG. 25 is a plan view illustrating an adhesive tape cutter according to a third embodiment of the present invention.
Figure 26:
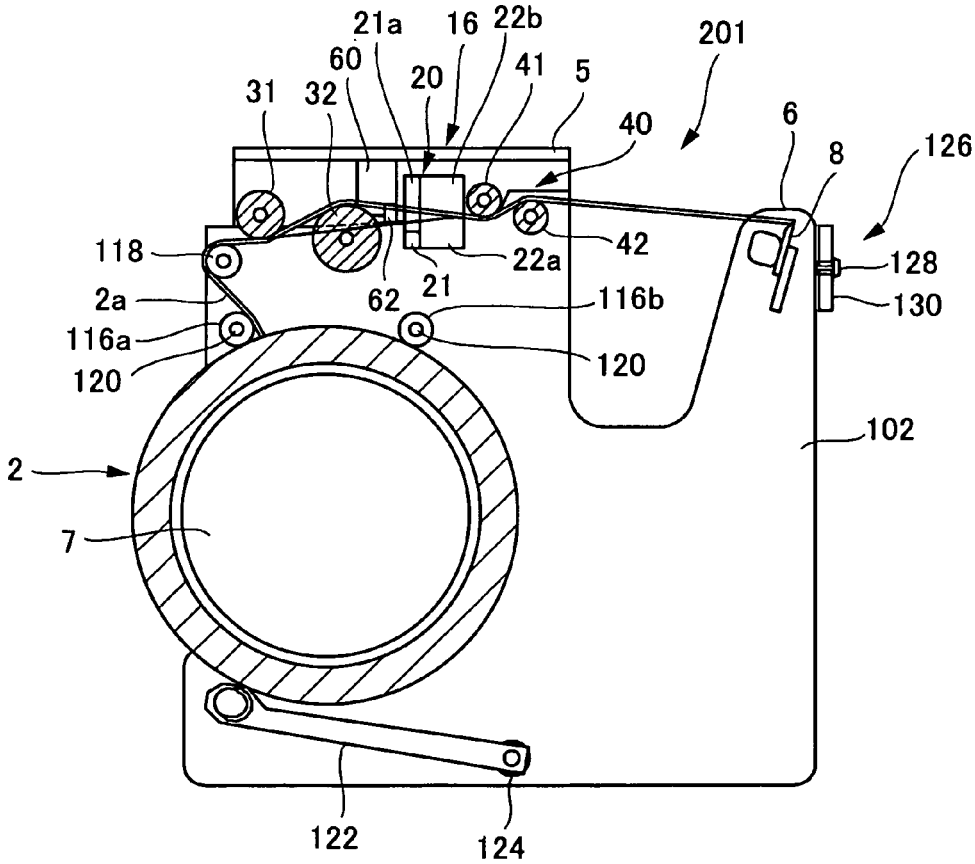
FIG. 26 is a sectional view along line A-A of FIG. 25.
Figure 27:
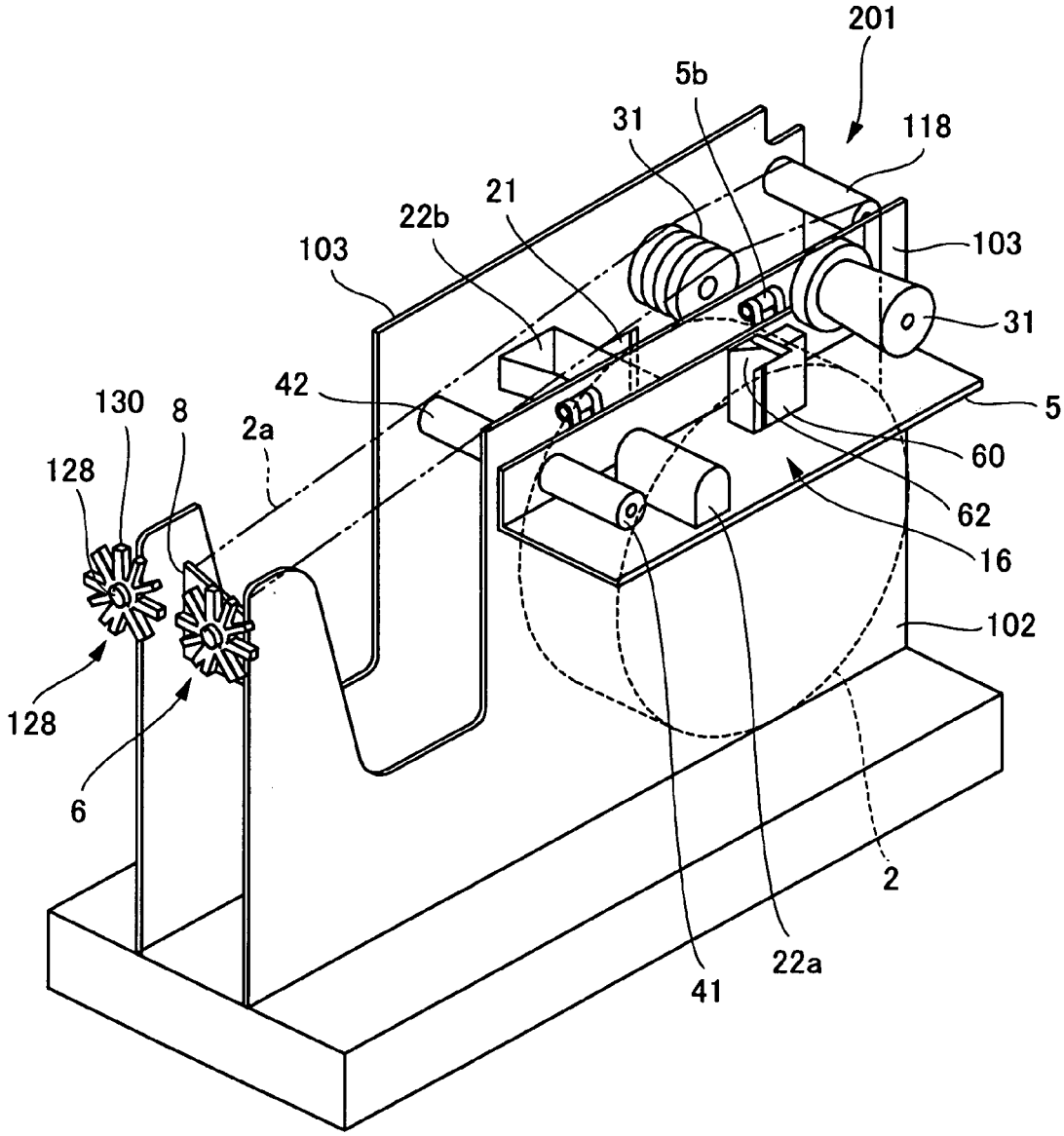
FIG. 27 is a general perspective view when the open/close cover is open.

FIGS. 25 to 27 show a third embodiment of the present invention; FIG. 25 is a plan view thereof; FIG. 26 is a sectional view along line A-A of FIG. 25; and FIG. 27 is a general perspective view when its open/close cover is opened.

Also in the third embodiment, the essential configuration of its main parts such as the double-portion forming means 16 is much the same as in the first and second embodiments, and the third embodiment differs therefrom in the structure of the tape holder as a tape support means. Accordingly, the different structure of the tape holder will be described below in detail, and as to the double-portion forming means 16, the same reference numerals indicate the same or like parts as in the first and second embodiments, and a description thereof is omitted.

As shown in FIGS. 25 to 27, in the third embodiment, the tape holder 11 constituting a tape support comprises at least two support rollers 116*a*, 116*b* and a pulling-out guide roller 118. These support rollers 116*a*, 116*b* and pulling-out guide roller 118 are rotatably, pivotably supported by support shafts 120 fixed to a side wall 103 of the main body 102. The pulling-out guide roller 118 is placed in between the positioning roller 31 and the support roller 116*a* on its back side and on the back side of a line joining both the axes of the rollers 118, 116*a*, and turns and guides the adhesive tape 2*a* to contact and press against the rollers 118, 116*a*.

Furthermore, a support lever 122 is provided under the adhesive-tape roll 2 to retain the adhesive-tape roll 2 not to come out, and is always biased by the force of a support spring 124 in the direction of the side where the adhesive tape 2*a* is pulled out to prevent the tape roll 2 from coming out of the main body 102.

With this configuration, without providing a holder shaft (not shown) in the central opening of the tape housing section 7 as is often used conventionally, the adhesive-tape roll 2 can be rotatably held against the tape tension by the two support rollers 116*a*, 116*b* closely contacting the adhesive-tape roll. Thus, without plugging the adhesive-tape roll onto the holder shaft in the central opening as in the conventional art, the adhesive-tape roll 2 can be easily loaded.

Moreover, because the pulling-out guide roller 4 turns the adhesive tape 2*a*, the adhesive-tape roll 2 can be placed and housed in the lower space of the main body 102. By this means, the main body is greatly reduced in length and height to become compact, and thus it is easy to install the tape cutter on a table of small space and much space saving can be achieved.

Furthermore, in the third embodiment the cutting section 6 is provided with an anti-finger-cut means 126 as shown in FIGS. 25 to 27. In the Figures, this anti-finger-cut means 126 comprises shafts 128 on opposite sides of the adhesive tape 2*a* to each of which an impeller 130 is rotatably coupled. With this configuration, when the adhesive tape 2*a* is pushed down in the middle between the impellers 130, the impellers rotate to move the tape down, and the tape can be pulled out. However, the impellers 130 are placed closely with the space between the impellers 130 set at 1 to 5 mm such that a finger cannot pass through between the left and right impellers 130. Thus, when the tape is cut, the impellers 130 blocks the finger not to touch the cutter blade 8, and the adhesive tape 2*a* can be cut safely.

Figure 28:
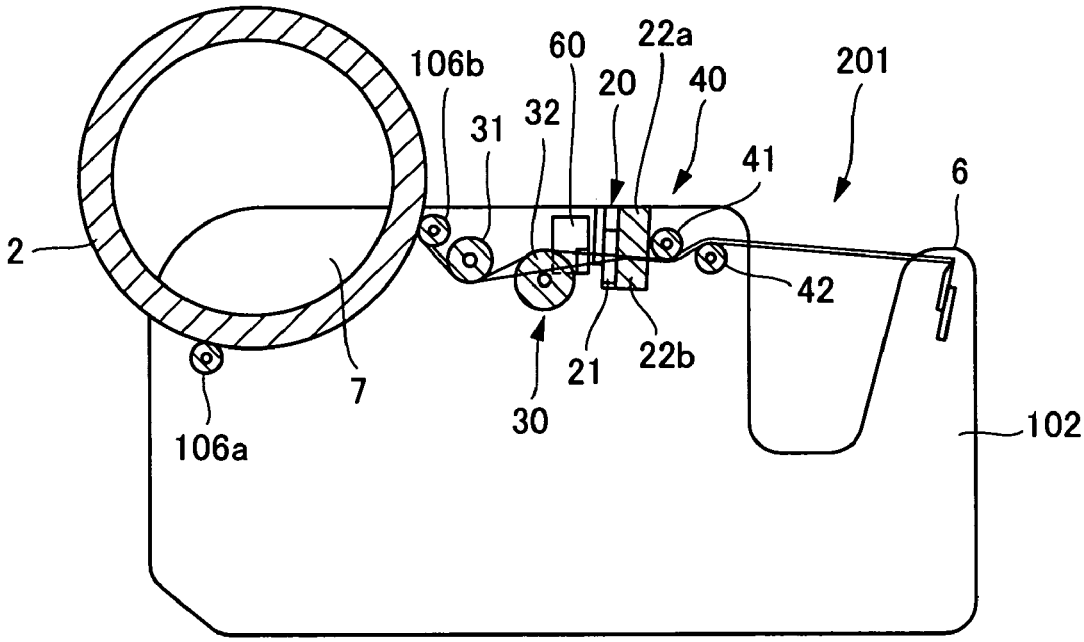
FIG. 28 is a schematic, side sectional view showing a variation on a tape support of the third embodiment.

FIG. 28 shows a variation on the structure of the support for the adhesive-tape roll 2. In this variation, as opposed to the above implementation, the adhesive-tape roll 2 is placed on and supported by the two support rollers 116*a*, 116*b*. In this case, since the adhesive-tape roll 2 sticks out upward from the main body 102 of the tape cutter, larger installation space is needed, but because the adhesive-tape roll 2 can be loaded from above, the tape cutter has the advantage that the exchange of adhesive-tape rolls 2 is easy.

Fourth Embodiment

Figure 29:
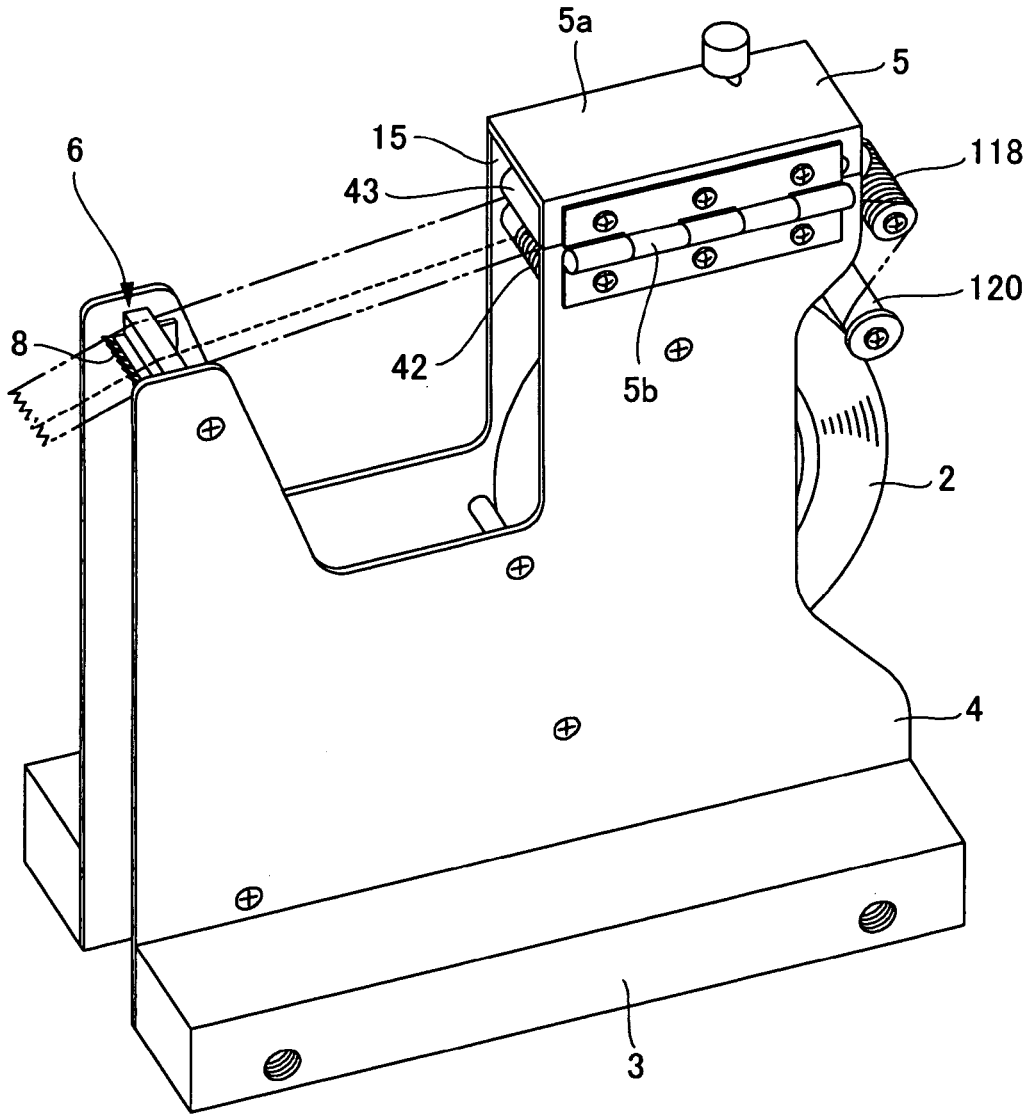
FIG. 29 is a general perspective view illustrating an adhesive tape cutter according to a fourth embodiment of the present invention.
Figure 30:
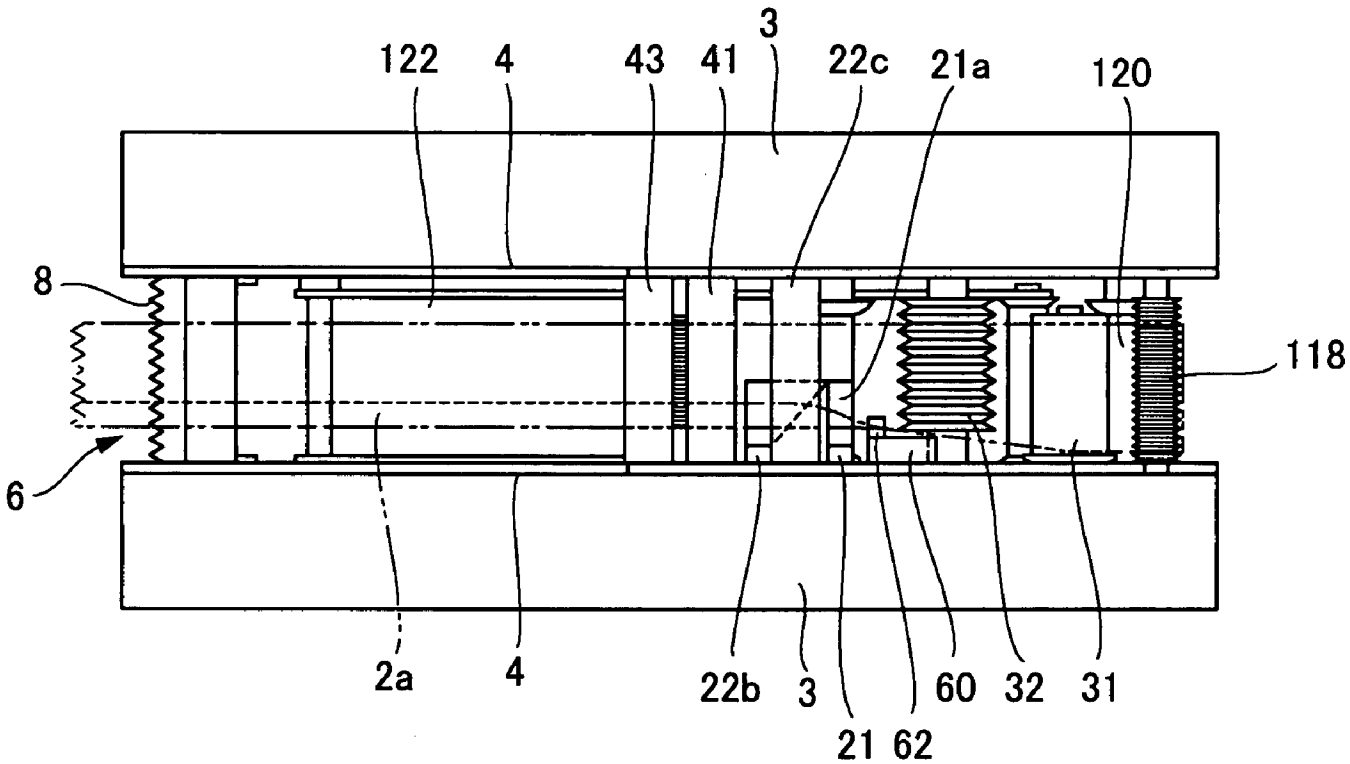
FIG. 30 is a partially cut-away plan view illustrating the configuration of the adhesive tape cutter of FIG. 29.
Figure 31:
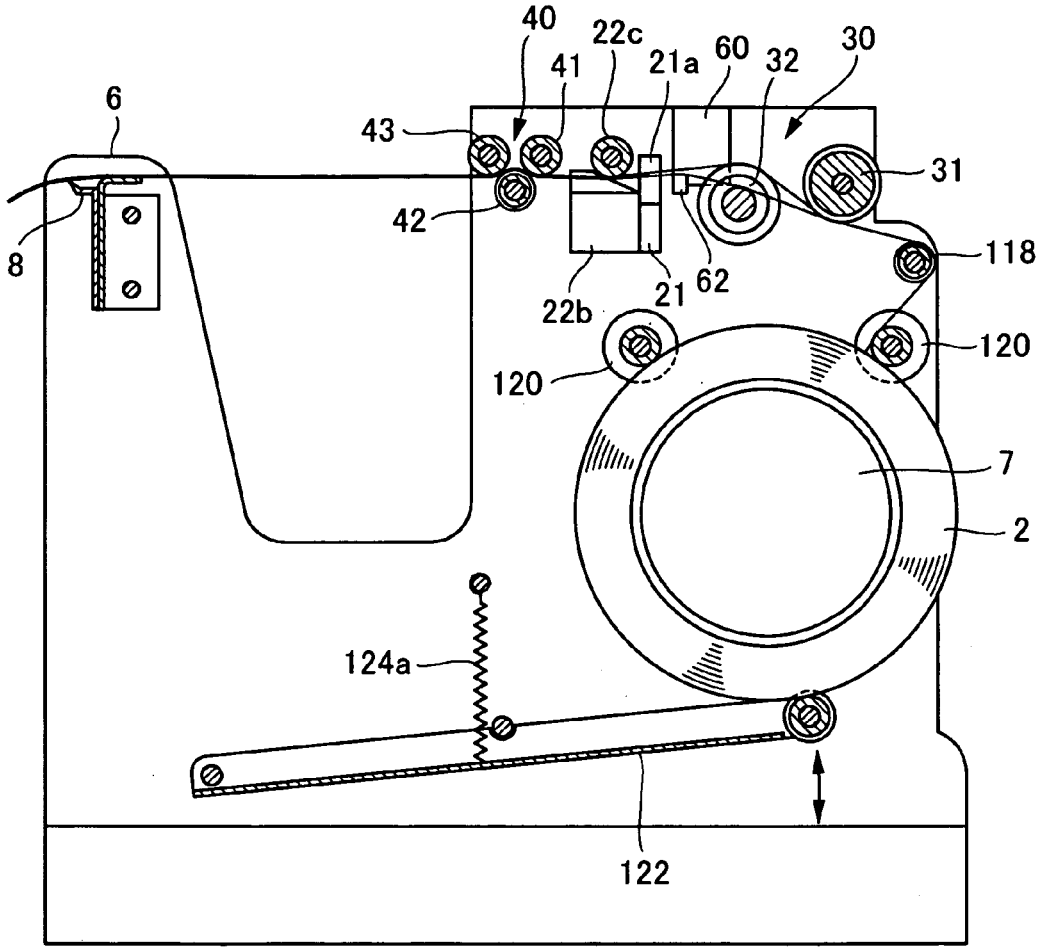
FIG. 31 is a sectional view along line A-A of FIG. 30.
Figure 32:
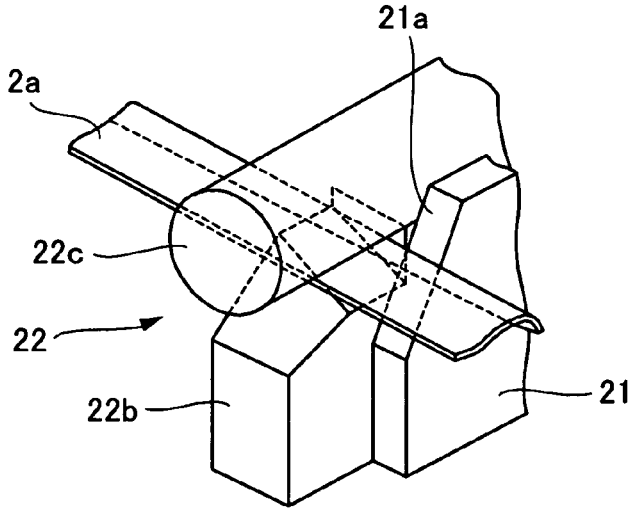
FIG. 32 is an enlarged perspective view of a folding mechanism.
Figure 33:
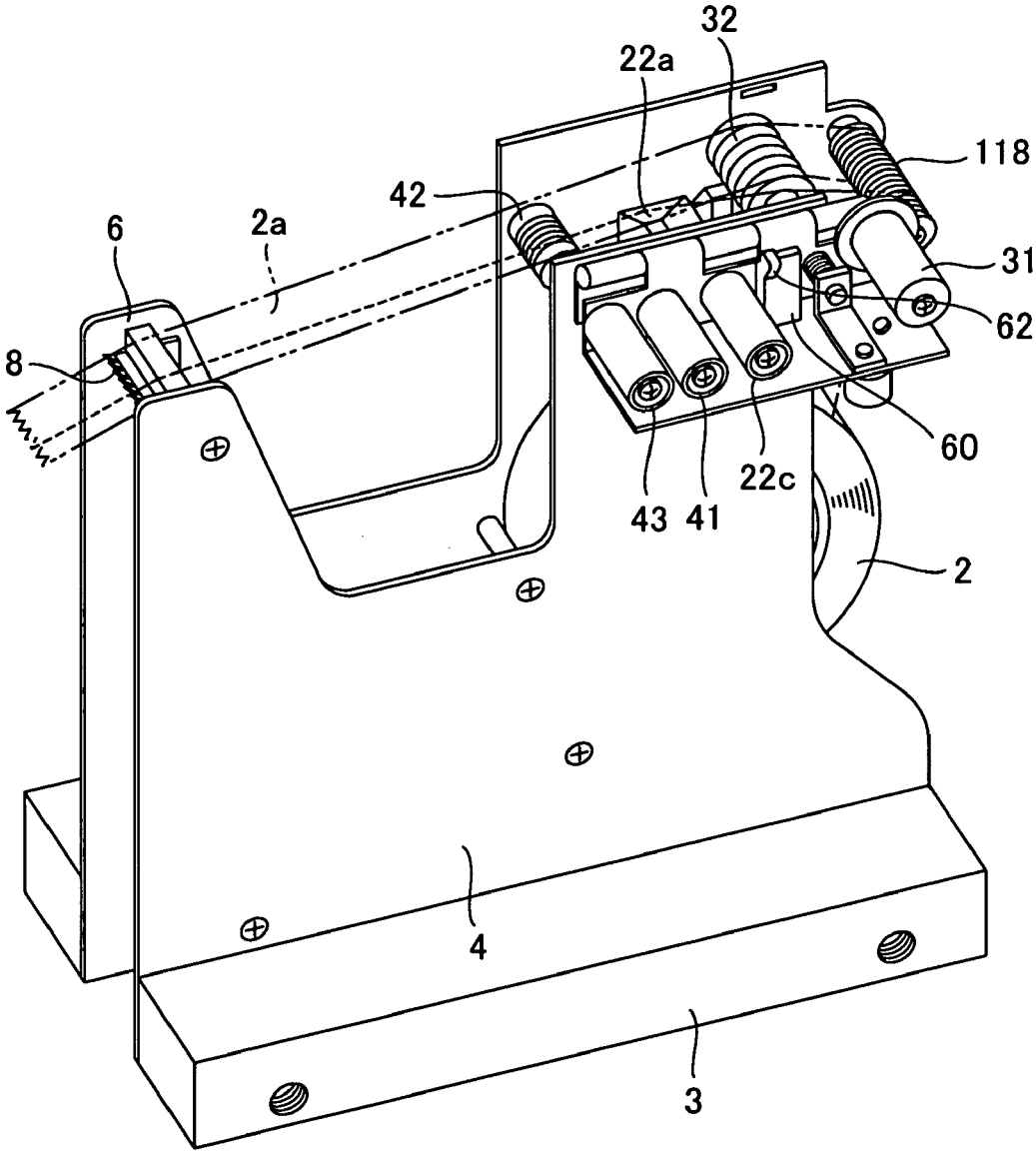
FIG. 33 is a general perspective view when the open/close cover is open.

FIGS. 29 to 33 show a fourth embodiment of the present invention; FIG. 29 is a general perspective view thereof; FIG. 30 is a plan view thereof; FIG. 31 is a sectional view along line A-A of FIG. 30; FIG. 32 is an enlarged perspective view of the folding mechanism; and FIG. 33 is a general perspective view when its open/close cover is opened.

Also in the fourth embodiment, the essential configuration of its main parts such as the double-portion forming means 16 is much the same as in the first to third embodiments, and the fourth embodiment differs a little in the structure of the folding mechanism 20. Accordingly, the structure of the folding mechanism 20 will be described below in detail, and as to the other parts, the same reference numerals indicate the same or like parts as in the first to third embodiments, and a description thereof is omitted.

Also in an adhesive tape cutter 301 of the fourth embodiment, the bending roller 32, the bending guide block 60 and the guide protrusion 62 of the bending mechanism 30 bend the side edge 2*a*S of the adhesive tape 2*a* backward so as to form an acute angle of about 60° with the opposite adhesive face. Then, the side edge 2*a*S is further bent at about 180°.

That is, the side edge 2*a*S of the adhesive tape 2*a* contacts and presses at the non-adhesive side against the sloping block 21 (a first guide portion) as the folding guide block of the folding mechanism 20 to form an acute angle of about 45° with the opposite adhesive face, and then contacts and presses against a base block 22*b* (a second guide portion) to be further bent at about 180°. This base block 22*b* has a wedge-shaped notched portion 23 on its top, and immediately above the notched portion 23, a press roller 22*c* is placed adjacent to the sloping block 21. This press roller 22*c*, corresponding to the top block 22*a* in the first to third embodiments, is fixed instead of the top block 22*a* to the open/close cover 5, and the base block 22*b* integral with the sloping block 21 is fixed to the fixed cover 4.

As such, the press roller 22*c* is provided instead of the top block 22*a* and by pressing the adhesive tape 2*a* against the press roller 22*c*, with reducing the tension acting on the adhesive tape 2*a*, the adhesive tape side edge 2*a*S can be folded smoothly, reliably. Hence, with reduced operation force in pulling-out, operability can be improved as much as possible. Here, if the winding angle of the adhesive tape 2*a* winding around the press roller 22*c* is set slightly larger thereby setting pressing force of the adhesive tape 2*a* larger, the opposite adhesive faces of the adhesive tape 2*a* can be stuck together by the press roller 22*c* to form a double portion. In this case, the sticking means 40 constituted by the three rollers 41, 42, 43 downstream thereof can be omitted from the configuration. Furthermore, a support lever 122 placed under the adhesive-tape roll 2 to retain the adhesive-tape roll 2 not to come out may always be biased by the force of a pulling coil spring 124*a* in the direction of the side where the adhesive tape 2*a* is pulled out.

The above embodiments are not intended to limit the present invention. It should be understood that various changes can be made therein without departing from the spirit and scope of the invention.

As described in detail by way of the embodiments of the present invention, with the tape cutter of the invention, a non-adhesive portion as a picking-off portion for facilitating removal of the adhesive tape can be easily formed along the longitudinal direction by folding the tape side edge and sticking, and also the function of forming the non-adhesive portion can be easily switched on/off, and the insertion and loading of the adhesive tape can be easily performed.

Moreover, when the open/close member is open, the non-adhesive portion is not formed on the adhesive tape, and hence, both adhesive tape having a non-adhesive portion formed and adhesive tape having no non-adhesive portion formed can be provided for being cut, thus improving the versatility of the tape cutter.

Furthermore, with the adhesive tape of the present invention, because there is provided a mark indicating an approximate lateral center of the adhesive face beside the non-adhesive portion, the work of sticking the adhesive tape having the non-adhesive portion formed to an appropriate position can be easily performed.

What is claimed is:

1. An adhesive tape cutter having a main body provided with a tape support that rotatably supports an adhesive tape roll in which the adhesive tape having one adhesive face is wound like a roll and a cutting section that cuts the adhesive tape pulled out from the adhesive tape roll supported by the tape support, wherein between the tape support and the cutting section of the main body there is provided a double-portion forming means that includes adhesive face-side members disposed on a side faced by the adhesive face of the adhesive tape and non-adhesive face-side members disposed on a side faced by a non-adhesive face thereof and that folds at least a longitudinal side edge of a predetermined width of the adhesive tape in a direction that the adhesive face is facing to form a double portion as a non-adhesive portion by pulling out the adhesive tape between the adhesive face-side members with both the members contacting and pressing against the adhesive tape, wherein the double-portion forming means is fixed to a holder that is attachable and detachable from the main body that comprises;

a bending roller as one of the adhesive face-side member that contacts the adhesive face of the adhesive tape except the side edge of the predetermined width to be bent;

a bending guide block as one of the non-adhesive face-side members that is placed opposite an end face of the bending roller and contacts and presses against the non-adhesive face of the side edge of the predetermined width to be bent, not contacting the bending roller, to sandwich the side edge between the end face of the bending roller and itself and bend the side edge of the predetermined width in the direction that the adhesive face is facing;

a folding guide block as one of the adhesive face-side members that has a guide portion contacting and pressing against the non-adhesive face of the bent side edge to bend the side edge to be at an acute angle and that is placed on the side faced by the adhesive face of the adhesive tape;

a sticking means as one of the non-adhesive face-side members that contacts and presses against the non-adhesive face of the adhesive tape having the side edge folded to stick together opposite adhesive faces of the folded adhesive tape;

the non-adhesive face-side members are supported by an open/close member that is openable and closable, and the open/close member is configured to be movable between a closed position where the non-adhesive face-side members contact and press against the adhesive tape through the double-portion forming means and an open position where the non-adhesive face-side members do not, and in the open position, the non-adhesive face-side members such that a path for the adhesive tape be inserted through is opened up.

2. The adhesive tape cutter according to claim 1, wherein the folding guide block has a first guide portion that guides and bends the side edge of the adhesive tape at a bending angle of about 135° and a second guide portion that bends the side edge at a bending angle of about 180°.

3. The adhesive tape cutter according to claim 2, wherein the first guide portion and the second guide portion together form a continuous curved surface on one side.

4. The adhesive tape cutter according to claim 1, wherein on the bending guide block, a guide protrusion is formed so as to contact the non-adhesive face of the bent side edge to guide and bend the side edge at a bending angle of about 120°.

5. The adhesive tape cutter according to claim 1, wherein a press member of the sticking means is a guide roller.

6. The adhesive tape cutter according to claim 1, wherein between the tape support and the double-portion forming means, there is provided a positioning means that positions the adhesive tape pulled out from the adhesive tape roll in such a position as to be fed to the double-portion forming means.

7. The adhesive tape cutter according to claim 6, wherein the positioning means is fixed to the open/close member.

8. The adhesive tape cutter according to claim 1, wherein the open/close member is moved between the open and closed positions by being rotated sideways relative to a direction that the adhesive tape is inserted through the path.

* * * * *